US010029382B2

(12) United States Patent
Fujihara

(10) Patent No.: US 10,029,382 B2
(45) Date of Patent: Jul. 24, 2018

(54) CUTTING APPARATUS

(71) Applicant: Shinya Fujihara, Obu (JP)

(72) Inventor: Shinya Fujihara, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 223 days.

(21) Appl. No.: 14/090,518

(22) Filed: Nov. 26, 2013

(65) Prior Publication Data

US 2014/0150619 A1 Jun. 5, 2014

(30) Foreign Application Priority Data

Nov. 30, 2012 (JP) ..... 2012-262584

(51) Int. Cl.

| | |
|---|---|
| ***B26D 7/26*** | (2006.01) |
| ***B26F 1/38*** | (2006.01) |
| *B26D 5/00* | (2006.01) |

(52) U.S. Cl.

CPC ..... *B26D 7/26* (2013.01); *B26F 1/3813* (2013.01); *B26D 5/007* (2013.01); *B26D 7/2614* (2013.01); *B26D 2007/2678* (2013.01); *Y10T 83/647* (2015.04)

(58) Field of Classification Search

CPC .. B26D 7/2614; B26D 7/2628; B26D 7/2642; B26D 7/26; Y10T 83/8822

USPC ..... 83/455, 614, 698.13

See application file for complete search history.

(56) References Cited

U.S. PATENT DOCUMENTS

| | | | | |
|---|---|---|---|---|
| 1,958,941 A | | 5/1934 | Chapman | |
| 3,246,903 A | * | 4/1966 | Sattler | B23B 31/202 279/47 |
| 3,339,279 A | * | 9/1967 | Sovar | B26D 3/085 30/164.9 |
| 4,514,117 A | | 4/1985 | Scott | |
| 4,608,891 A | | 9/1986 | Frisby et al. | |

(Continued)

FOREIGN PATENT DOCUMENTS

| | | | | |
|---|---|---|---|---|
| EP | 1084804 A1 | * | 3/2001 | B26D 3/085 |
| EP | 1557246 A2 | * | 7/2005 | B26D 7/015 |
| JP | S62-43795 U | | 3/1987 | |
| JP | 63-063496 U | | 4/1988 | |
| JP | S63-68495 U | | 5/1988 | |
| JP | H04-193597 A | | 7/1992 | |
| JP | 06-066989 U | | 9/1994 | |

(Continued)

OTHER PUBLICATIONS

Notification of Reasons for Refusal dated Sep. 6, 2016 issued in the corresponding Japanese patent application No. 2012-262584.

*Primary Examiner* — Jennifer Swinney
(74) *Attorney, Agent, or Firm* — K&L Gates LLP

(57) ABSTRACT

A cutting apparatus includes a platen receiving an object to be cut, a carriage with a cartridge holder to which a cutter cartridge is detachably attachable and a pressing unit located on the carriage or the cartridge holder and switchable between a fixing position and an open position. The cartridge holder is formed with an opening through which the cutter cartridge is inserted and has an abutted portion against which an abutment abuts and which is a receiving portion having a tapered surface contacting with at least a part of the abutment. The receiving portion includes a plurality of elastic portions and a blocking portion. The blocking portion controls a position of a casing of the cutter cartridge. The casing abuts against the blocking portion when the cutter cartridge is inserted through the opening and the cartridge holder and the pressing unit is switched to the fixing position.

11 Claims, 13 Drawing Sheets

(56) References Cited

U.S. PATENT DOCUMENTS

| | | | | |
|---|---|---|---|---|
| 4,624,169 | A | 11/1986 | Nelson | |
| 5,094,134 | A * | 3/1992 | Mizukoshi | B26D 7/2614 33/18.1 |
| 5,197,198 | A * | 3/1993 | Onozato | B26F 1/3806 33/1 M |
| 5,522,605 | A | 6/1996 | Lewis et al. | |
| 5,957,467 | A | 9/1999 | Hornung | |
| 6,131,498 | A | 10/2000 | Gerber | |
| 6,341,548 | B1 | 1/2002 | Hirahata et al. | |
| 6,997,095 | B1 | 2/2006 | Kishi et al. | |
| 7,650,825 | B1 | 1/2010 | Lee et al. | |
| 7,930,958 | B2 | 4/2011 | Workman et al. | |
| 2005/0186010 | A1 | 8/2005 | Shibata et al. | |
| 2007/0012152 | A1 * | 1/2007 | Workman | B26D 7/2628 83/614 |
| 2007/0227332 | A1 * | 10/2007 | Causse | B26D 7/015 83/879 |
| 2009/0000444 | A1 | 1/2009 | Johnson et al. | |
| 2010/0089878 | A1 | 4/2010 | Halser | |
| 2010/0199827 | A1 | 8/2010 | Colegrove | |
| 2011/0280999 | A1 * | 11/2011 | Crystal | A21C 15/002 426/231 |
| 2012/0247292 | A1 * | 10/2012 | Kawaguchi | B26D 5/005 83/76.1 |
| 2012/0253504 | A1 | 10/2012 | Kawaguchi et al. | |
| 2014/0150618 | A1 | 6/2014 | Fujihara | |

FOREIGN PATENT DOCUMENTS

| | | | | |
|---|---|---|---|---|
| JP | H06-66989 | U | 9/1994 | |
| JP | 2000-000796 | A | 1/2000 | |
| JP | 2009-050979 | A | 3/2009 | |
| JP | 2014-108464 | A | 6/2014 | |
| WO | WO 9628286 | A1 * | 9/1996 | B26D 7/2614 |

* cited by examiner

CUTTING APPARATUS

CROSS-REFERENCE TO RELATED APPLICATIONS

This application is based upon and claims the benefit of priority from the prior Japanese Patent Application No. 2012-262584 filed on Nov. 30, 2012, the entire contents of which are incorporated herein by reference.

BACKGROUND

1. Technical Field

The present disclosure relates to a cutting apparatus which cuts an object using a cutter cartridge.

2. Related Art

Cutting apparatuses have conventionally been known which cut an object to be cut, such as paper, according to cutting data thereby to obtain a predetermined pattern. The cutting apparatuses include a transfer mechanism transferring the object in a front-back direction (the Y direction) and a carriage moving a cutter cartridge having a cutter in a right-left direction (the X direction). A desired pattern is cut from the object by the aforementioned operations.

The cutting apparatuses of the above-described type include a holder which is provided on the carriage and to which the cutter cartridge (or a cutter unit) is detachably attached. The holder is formed into the shape of a cylinder extending in an up-down direction. The cutter unit is formed into a substantially columnar shape and is attached inside the holder. The cutter unit has an outer periphery formed with an engagement recess.

The holder has an inner periphery having a slightly larger diameter than that of the cutter unit. The holder is provided with two O-rings disposed on upper and lower parts of the inner periphery thereof. The cutter unit is inserted through the holder and supported on the O-rings in the inserted state. The holder is provided with an engaging member engageable with the engagement recess of the cutter unit. The engaging member is biased by a spring so as to press a side of the cutter unit inward. The cutter unit is held by the holder of the carriage when the engaging member engages the engagement recess. The engaging member is provided with an operating knob, which is pulled against the biasing force of the spring in a direction such that the operating knob departs from the cutter unit, thereby being disengaged from the engagement recess.

In the above-described cutting apparatuses using the cutter unit, however, there is a possibility that dimensions of the cutter unit, the holder and the engaging member would vary. Accordingly, the cutter unit inserted through the holder would sometimes rattle with the result that the object cannot be cut reliably. More specifically, a blade edge of the cutter receives a reactive force as resistance to cutting from the object when the object is moved by the transfer mechanism relative to the cutter to be cut by the cutter. In this case, when the cutter unit rattles in an up-down direction, the position of the blade edge is moved slightly upward. A depth of cut into the object is reduced with the upward movement of the blade edge, with the result that a part that cannot be cut sometimes occurs.

Furthermore, the resistance to cutting sometimes causes the cutter unit to rattle against the biasing force of the spring and/or the elastic force of the O-rings. In this case, the cutter is displaced from the original center position in the holder. This entails reduction in the cutting accuracy.

SUMMARY

Therefore, an object of the disclosure is to provide a cutting apparatus which can reliably cut the object and improve the cutting accuracy.

The present disclosure provides a cutting apparatus including a platen receiving an object to be cut, a carriage provided with a cartridge holder to which a cutter cartridge is detachably attachable, a moving unit which moves at least one of the object to be cut and the carriage relative to each other so that the object is cut by a cutter of the cutter cartridge by the relative movement between the object and the carriage and a pressing unit which is provided on the carriage or the cartridge holder and is switchable between a fixing position where the pressing unit presses the cutter cartridge attached to the cartridge holder thereby to fix the cutter cartridge and an open position where the pressing unit releases the cutter cartridge from a fixed state. The cutter cartridge has an abutment. The cartridge holder comprises a holder frame having an open interior and at least one holder having an inner periphery having an inner diameter, said holder having an abutted portion against which the abutment abuts. At least one of the abutment and the abutted portion is tapered, and the abutted portion is a receiving portion having a tapered surface contacting with at least a part of the abutment. When located at the fixing position, the pressing unit is configured to press the cutter cartridge in the insertion direction thereby to fix the cutter cartridge while the abutment is in abutment with the receiving portion, whereby the cutter is held at a predetermined position. The cutter cartridge includes a casing forming an outer part of the cutter cartridge and having an outer surface formed with the abutment. The receiving portion includes a plurality of elastic portions which protrude radially inward from an inner periphery of the opening and are elastically deformable, and have the respective tapered surfaces and protruding radially inward from a part of the inner periphery of the opening independent of parts of the inner periphery of the opening from which the elastic portions protrude. The blocking portion controls a position of a casing of the cutter cartridge in a pressing direction of the pressing unit against the cutter cartridge. When the cutter cartridge is inserted through the opening and further through the cartridge holder and the pressing unit is switched to the fixing position, the casing abuts against the blocking portion protruding radially inward with respect to the opening, thereby preventing movement of the pressing unit and is fixed in a state where the abutment abuts against the tapered surfaces of the elastic portions in the insertion direction to elastically deform the elastic portions.

DETAILED DESCRIPTION

Figure 1:
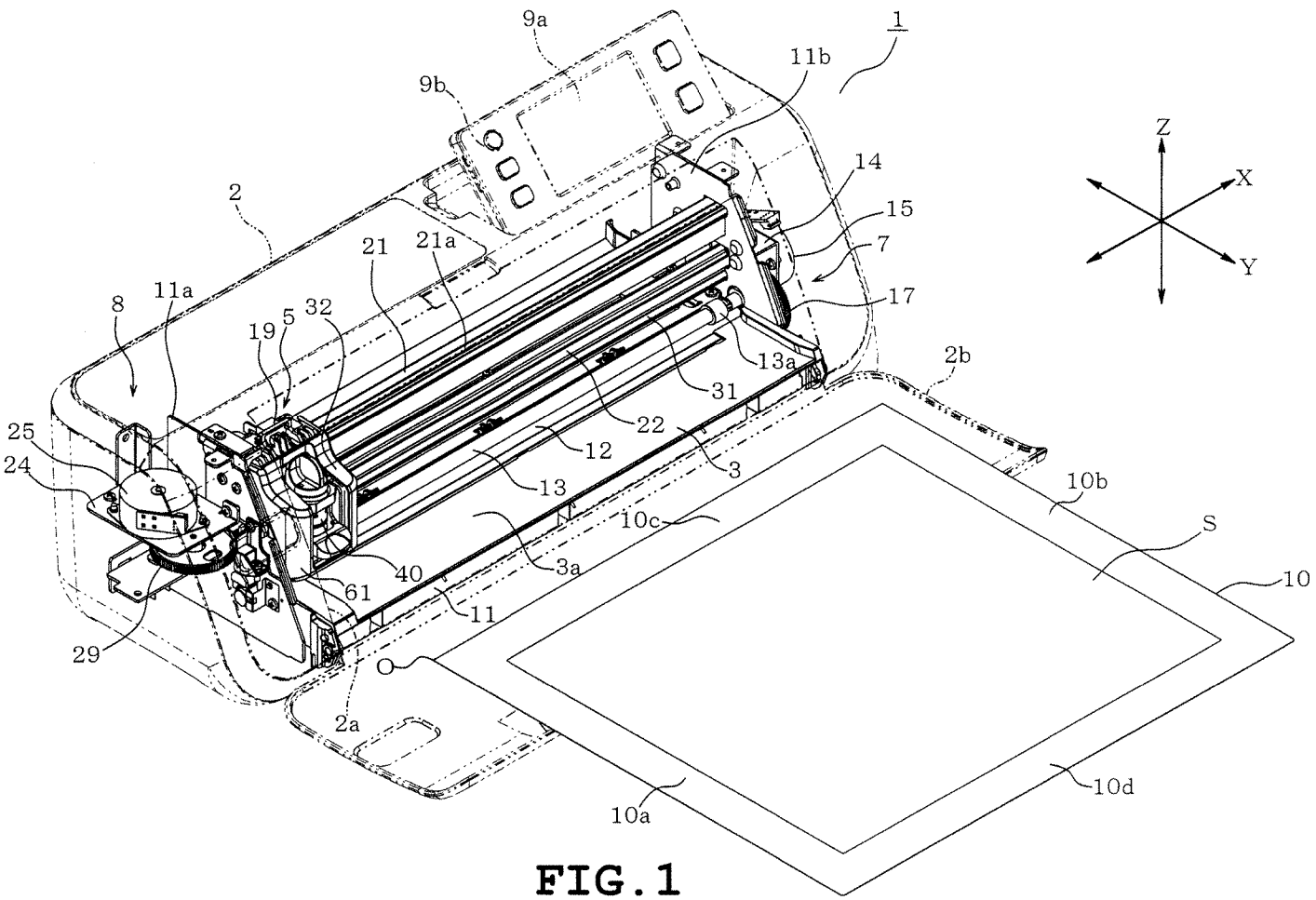
FIG. 1 is a perspective view of a cutting apparatus according to a first example, showing an inner structure of the cutting apparatus together with a body cover.

Several examples of the cutting apparatus will be described with reference to the accompanying drawings. Referring to FIG. 1, the cutting apparatus 1 of the first example includes a body cover 2 serving as a housing, a platen 3 provided in the body cover 2, a cutting head 5 serving as a cutting unit and a scanner 6 (see FIGS. 2 and 13) serving as an image reader.

The cutting apparatus 1 further includes a holding sheet 10 adapted to hold an object S which is to be cut and an image of which is to be read. The object S includes, for example, a plurality of types of objects to be cut such as paper sheet and cloth and paper carrying original drawing and photograph. Regarding the cutting apparatus 1 of the example, a plurality of types of cutter cartridges 40 is prepared according to the types of objects. One of the cutter cartridges 40 is to be attached to a cartridge holder 32 of a cutting head 5 as will be described later.

The body cover 2 is formed into the shape of a generally horizontally long rectangular box. The body cover 2 includes a front having a front opening 2*a* and front cover 2*b* opening and closing the front opening 2*a*. The holding sheet 10 holding the object S is set on the platen 3 while the front opening 2*a* is open. Alternatively, the cutter cartridge 40 is attached to or detached from the cartridge holder 32 while the front opening 2*a* is open.

The cutting apparatus 1 includes a transfer mechanism 7 which transfers the object S in a predetermined transfer direction (the Y direction). The cutting apparatus 1 also includes a cutter moving mechanism 9 which moves the cutting head 5 in a direction intersecting with the transfer direction of the object S (the X direction perpendicular to the transfer direction, for example). In the following description, the transfer direction of the object S by the transfer mechanism 7 will be referred to as "front-back direction." More specifically, the cutting apparatus 1 has a side where the opening 2*a* is located. The side of the cutting apparatus 1 will be referred to as "front" and a side opposed to the front will be referred to as "back." A front-back direction will be referred to as the Y direction and a right-left direction perpendicular to the Y direction will be referred to as the X direction, as shown in FIG. 1.

A display 9*a* and an operation device 9*b* including various operation switches are provided on a right upper surface of the body cover 2. The display 9*a* comprises a full-color liquid-crystal display. The display 9*a* is configured to display various patterns, necessary messages and the like to a user. The operation device 9*b* is configured to be operable for selection of a pattern displayed on the display 9*a*, the setting of various parameters, an indication of function, data input and the like.

Figure 2:
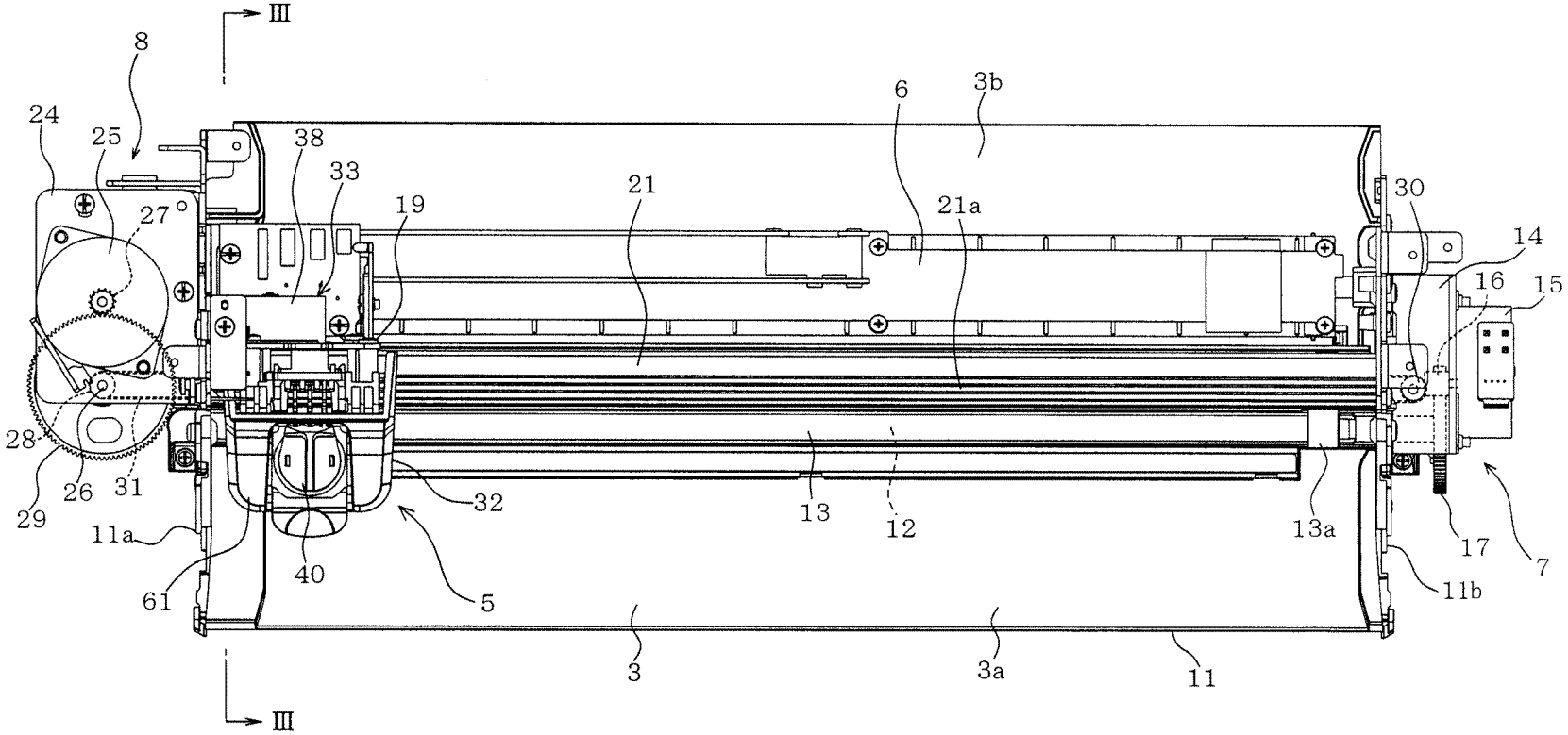
FIG. 2 is a plan view of the cutting apparatus, showing the inner structure of the cutting apparatus.

The platen 3 is provided for receiving the underside of the holding sheet 10 in the cutting of the object S. The platen 3 includes a front platen 3*a* and a rear platen 3*b* as shown in FIG. 2. The platen 3 has an upper surface which is horizontal. The holding sheet 10 holding the object S is placed on the platen 3 and transferred in a placed state. The holding sheet 10 is made from a synthetic resin material and formed into a rectangular sheet shape. The holding sheet 10 has an upper side with an adhesive layer 10*v* (see FIG. 12) formed by applying an adhesive agent to an inside region thereof except for peripheral edges 10*a* to 10*d*. The adhesive layer 10*v* has adhesion set to a small value such that the object S can easily be removed therefrom. The user affixes the object S to the adhesive layer 10*v*, whereby the object S is held on the holding sheet 10.

The transfer mechanism 7 and the cutter moving mechanism 8 are configured as a relative movement unit which moves the holding sheet 10 holding the object S and the cutting head 5 in the X direction and the Y direction relative to each other. The transfer mechanism 7 transfers the holding sheet 10 on the upper surface of the platen 3 freely in the Y direction. More specifically, a machine frame 11 is provided in the body cover 2 as shown in FIGS. 1 and 2. The apparatus frame 11 is provided with a sidewall 11*a* located at the left side of the platen 3 and a sidewall 11*b* located at the right side of the platen 3. The sidewalls 11*a* and 11*b* are disposed so as to face each other. A driving roller 12 and a pinch roller shaft 13 are mounted between the sidewalls 11*a* and 11*b* so as to be located in a space defined between the front and rear platens 3*a* and 3*b*. The driving roller 12 and the pinch roller shaft 13 both extend in the right-left direction and are arranged one above the other. The driving roller 12 is located under the pinch roller shaft 13.

The driving roller 12 is disposed so that an upper end thereof is substantially at the level of an upper surface of the platen 3. The driving roller 12 has right and left ends mounted on the respective sidewalls 11*b* and 11*a* so as to be rotatable. The right end of the driving roller 12 extends rightward through a hole (not shown) in the right sidewall 11*b* as shown in FIG. 2. A driven gear 17 having a larger diameter is secured to a right distal end of the driving roller 12. A mounting frame 14 is fixed to the outer surface side of the right sidewall 11*b*. A Y-axis motor 15 is mounted on the mounting frame 14. The Y-axis motor 15 is comprised of a stepping motor, for example. The Y-axis motor 15 has an output shaft to which a smaller-diameter driving gear 16 is fixed. The driving gear 16 is brought into mesh engagement with the driven gear 17.

The pinch roller 13 has right and left ends both of which are mounted on the sidewalls 11*b* and 11*a* so as to be rotatable and displaceable slightly in the up-down direction respectively. Springs (not shown) are provided for biasing the right and left ends of the pinch roller 13 downward respectively. Accordingly, the pinch roller 13 is normally biased downward (or to the driving roller 12 side) by the springs. The pinch roller 13 has slightly larger-diameter roller portions located near the right and left ends thereof respectively. Only the right one 13*a* of the roller portions is shown in FIGS. 1 and 2.

The right and left edges 10*b* and 10*a* of the holding sheet 10 are thus held between the driving roller 12 and the roller portions of the pinch roller 13. Upon drive of the Y-axis motor 15, normal or reverse rotation thereof is transmitted via the gears 16 and 17 to the driving roller 12, whereby the holding sheet 10 is moved backward or forward together with the object S. The transfer mechanism 7 is comprised of the driving roller 12, the pinch roller 13, the Y-axis motor 15 and the gears 16 and 17.

The cutter moving mechanism 8 is configured to move a carriage 19 of the cutting head 5 freely in the X direction. More specifically, a pair of guide rails 21 and 22 are fixed between the sidewalls 11*a* and 11*b* so as to be located slightly in the rear of and above the pinch roller 13, as shown in FIGS. 1 and 2. The guide rails 21 and 22 extend substantially in parallel to the pinch roller 13, that is, in the right-left direction. Each one of the guide rails 21 and 22 has a substantially C-shaped section as viewed in the extending direction or in the direction perpendicular to a plane of paper of FIG. 3. The upper and lower guide rails 21 and 22 are disposed symmetric in the up-down direction so that open sides of the C-shaped guide rails 21 and 22 are opposed to each other.

The upper guide rail 21 has an upper surface formed with a guide groove 21*a* extending from the right end to the left end. The lower guide rail 22 has a lower surface also formed with a guide groove 22*a* (shown only in FIG. 3) extending from the right end to the left end. The carriage 19 has a side having two protrusions 23 formed on upper and lower parts of the side respectively. The protrusions 23 are located so that the guide grooves 21*a* and 22*a* are interposed therebetween. The protrusions 23 extend in the right-left direction and engage the guide grooves 21*a* and 22*a* respectively. The carriage 19 is thus supported by the guide rails 21 and 22 so as to be slidable in the right-left direction.

A horizontal mounting frame 24 is mounted on a slightly rear outer surface of the left sidewall 11*a* as shown in FIGS. 1 and 2. Art X-axis motor 25 is mounted on the underside of the mounting frame 24 so as to be directed downward. A vertically extending pulley shaft 26 (see FIG. 2) is rotatably mounted on a frontward upper surface of the mounting frame 24 so as to extend vertically in front of the X-axis motor 25. The X-axis motor 25 has an output shaft to which a smaller diameter driving gear 27 is fixed. A driven gear 29 and a timing pulley 28 are rotatably mounted on the pulley shaft 26. The driven gear 29 is brought into mesh engagement with the driving gear 27. The timing pulley 28 and the driven gear 29 are formed so as to be rotated together.

On the other hand, a timing pulley 30 is rotatably mounted on the right mounting frame 14 with an axis thereof being directed in the up-down direction. A timing belt 31 extends horizontally in the right-left direction between the timing pulleys 28 and 30. The timing belt 31 includes a midway part connected to a mounting portion (not shown) of the carriage 19. The sidewalls 11*a* and 11*b* have through holes through which the timing belt 31 passes, respectively.

Upon drive of the X-axis motor 25, normal or reverse rotation thereof is transmitted via the gears 27 and 29 and the timing pulley 28 to the timing belt 31, with the result that the carriage 19 (the cutting head 5) is moved rightward or leftward. The carriage 19 is thus moved in the right-left direction perpendicular to the direction in which the object S is transferred. The cutter moving mechanism 8 is thus comprised of the guide rails 21 and 22, the X-axis motor 25, the gears 27 and 29 as a reduction gear mechanism, the timing pulleys 28 and 30 and the timing belt 31.

Figure 3:
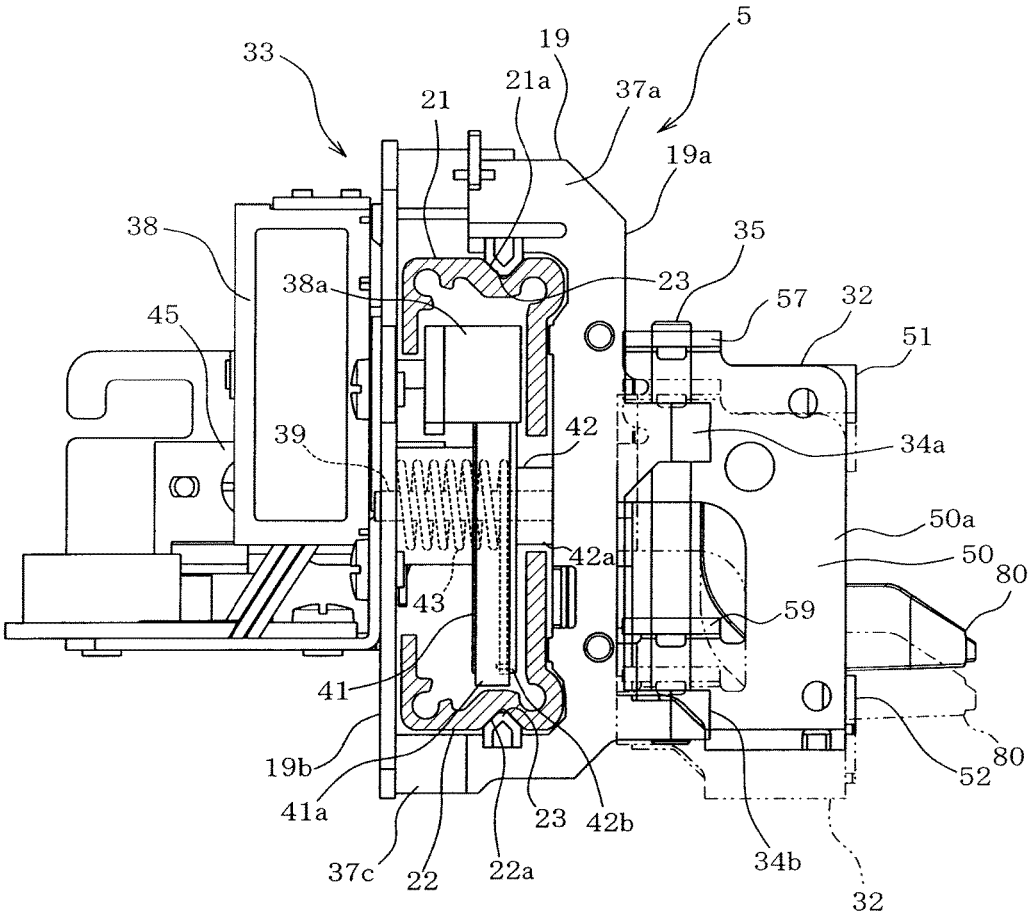
FIG. 3 is a longitudinal left side section taken along line III-III in FIG. 2.
Figure 4A:
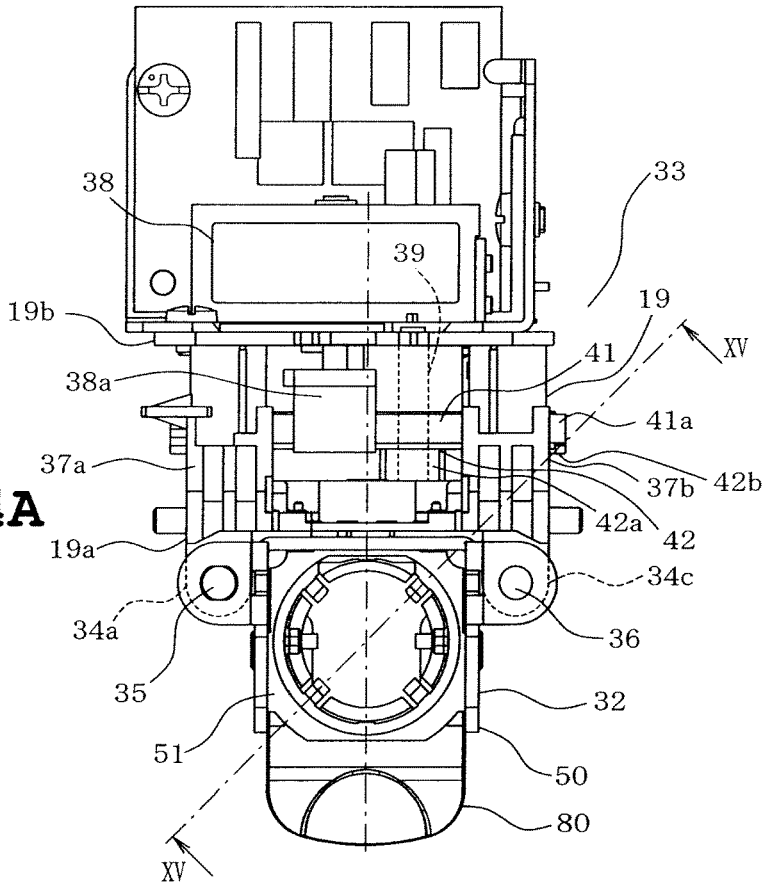
FIGS. 4A and 4B are a plan view and a front view of a carriage together with a cartridge holder respectively.

The cutting head 5 includes a cartridge holder 32 and an up-down drive mechanism 33 both disposed in front of and in the rear of the carriage 19 respectively, as shown in FIGS. 3 and 4A. The up-down drive mechanism 33 drives the cartridge holder 32 in the up-down direction (the Z direction) together with a cartridge 40. The construction of the cutting head 5 will now be described with reference to FIGS. 3 to 12.

Figure 4B:
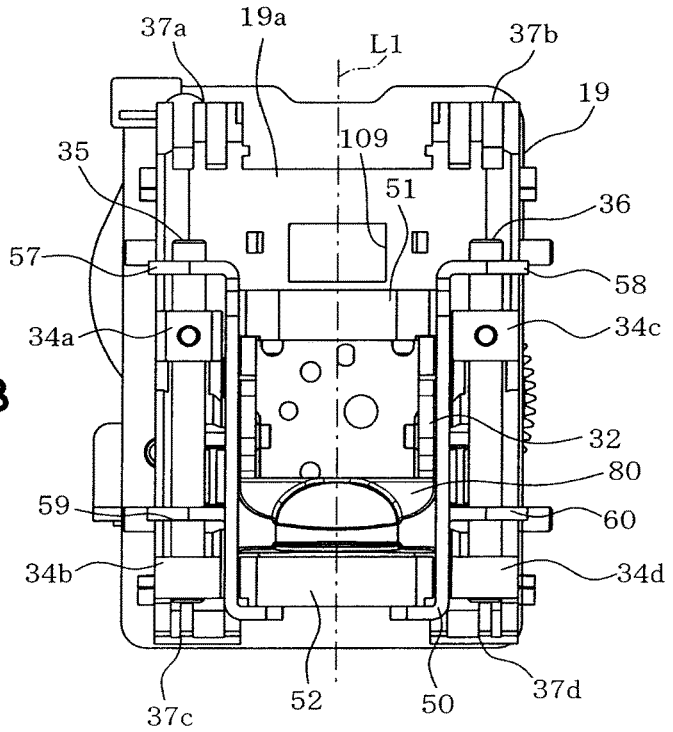

The carriage 19 has a front wall 19*a* formed into the shape of a slightly vertically long rectangular plate as viewed at the front, as shown in FIG. 4B. The front wall 19*a* has a left end provided with a pair of upper and lower supports 34*a* and 34*b* protruding frontward. A shaft 35 is formed into the shape of a rounded bar and disposed through the supports 34*a* and 34*b* thereby to be fixed so as to be long in the up-down direction. The front wall 19*a* also has a right end provided with supports 34*c* and 34*d*. A shaft 36 is disposed through the supports 34*c* and 34*d* thereby to be fixed. The shafts 35 and 36 are inserted through both sides of the cartridge holder 32 (insertion holes 57*a* to 60*a* as will be described later; and see FIG. 5A) respectively. As a result, the cartridge holder 32 is supported so as to be movable in the up-down direction.

The carriage 19 further has an upper side provided with a pair of right and left upper arms 37*b* and 37*a* both extending rearward from the front wall 19*a*, as shown in FIGS. 3 and 4A. The upper arms 37*a* and 37*b* have the aforementioned protrusions 23 which engage the guide groove 21*a* of the guide rail 21, respectively. The carriage 19 also has a lower side provided with a pair of right and left lower arms 37*c* and 37*d* as shown in FIG. 4B. The lower arms 37*c* and 37*d* have the aforementioned protrusions 23 which engage the guide groove 22*a* of the guide rail 22, respectively. The carriage 19 has a rear wall 19*b* which is formed into the shape of a substantially rectangular plate. The rear wall 19*b* has four corners fixed to rear ends of the arms 37*a* to 37*d*. Thus, the carriage 19 is formed into a shape such that the upper and lower arms 37*a* to 376 and the front and rear walls 19*a* and 19*b* surround the upper and lower sides and the front and rear sides of the guide rails 21 and 22.

A Z-axis motor 38 is mounted on a slightly upper part of the rear wall 19*b* of the carriage 19 so as to be directed frontward as shown in FIGS. 3 and 4A. The Z-axis motor 38 is comprised of a stepping motor, for example and has an output shaft to which a smaller diameter driving gear 38*a* is fixed. A frontwardly extending gear shaft 39 is mounted on the rear wall 19*b* so as to be located rightwardly below the Z-axis motor 38. A driven gear 41 and a pinion gear 42 are rotatably supported on the gear shaft 39.

The driven gear 41 has a smaller diameter portion and a larger diameter portion both formed integrally therewith. The larger diameter portion is formed with a gear 41*a* brought into mesh engagement with the driving gear 38*a* (see FIGS. 3 and 15). The driven gear 41 is formed with a housing portion having an open front. A torsion coil spring 43 which will be described later is to be housed in the housing portion. The pinion gear 42 has a flange 42*b* and a smaller diameter portion both formed integrally therewith. The flange 42*b* covers the housing portion of the driven gear 41 from the front. The smaller diameter portion is formed with a gear 42*a*. The torsion coil spring 43 has two ends one of which is locked to the driven gear 41 side. The other end of the torsion coil spring 43 is locked to the pinion gear 42 side. A rack 44 formed integrally with the cartridge holder 32 is brought into mesh engagement with a gear 42*a* of the pinion gear 42 (see FIGS. 4A and 5C).

Upon drive of the Z-axis motor 38, normal or reverse rotation thereof is transmitted to the rack 44 via the driving gear 38*a*, the driven gear 41, the torsion coil spring 43 and the pinion gear 42, whereby the cartridge holder 32 is moved upward or backward together with the cutter cartridge 40. Consequently, the cutter cartridge 40 is moved between a lowered position (see alternate long and two short dashes line in FIG. 3) where a blade edge 4*a* (see FIG. 12) of a cutter 4 passes through the object S, pressing against the object S and a raised position where the blade edge 4*a* departs from the object S by a predetermined distance. The up-down drive mechanism 33 includes the Z-axis motor 38, the gears 38*a*, 41 and 42 as the reduction gear mechanism, the torsion coil spring 43 and the rack 44. Since the gears 38*a*, 41 and 42 are disposed so as to be housed in the guide rails 21 and 22 as shown in FIG. 3, the cutting apparatus can achieve a size reduction.

Figure 13:
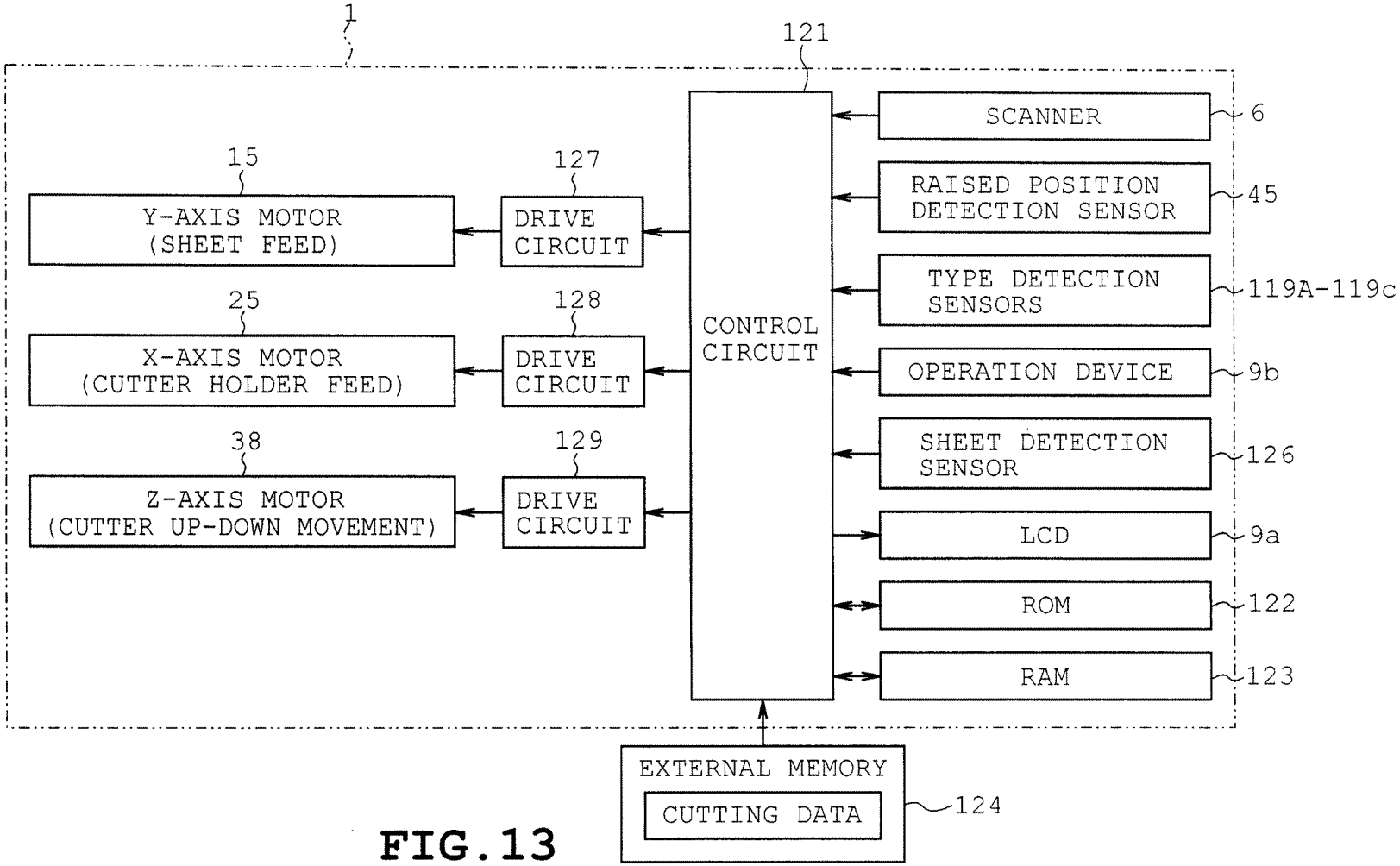
FIG. 13 is a block diagram showing an electrical arrangement of the cutting apparatus.

A raised position detection sensor 45 is provided on the rear wall 19*b* on the right of the Z-axis motor 38 (see FIGS. 3 and 13). The raised position detection sensor 45 is configured to detect the raised position of the cartridge holder 32 to which the cutter cartridge 40 is attached. More specifically, a shutter piece (not shown) is provided so as to be rotated with the driven gear 41. The raised position detection sensor 45 is an optical sensor comprised of a photo-interrupter detecting a rotational position of the shutter piece. As a result, the raised position of the cartridge holder 32 to which the cutter cartridge 40 is attached is defined on the basis of a detection signal of the raised position detection sensor 45.

Rotational movement of the Z-axis motor 38 is transferred via the driven gear member 41 and the torsion coil spring 43 to the pinion gear member 42 to be converted to up/down movement between the pinion gear member 42 and the rack 44, as described above. The conversion will be described in detail in the following. When the Z-axis motor 38 is driven to be rotated clockwise in a front view, the driven gear member 41 is rotated counterclockwise in a front view. The pinion gear member 42 is rotated counterclockwise via the torsion coil spring 43 as the result of counterclockwise rotation of the driven gear member 41. The rack 44 is moved downward by the gear 42*a* as the result of counterclockwise rotation of the pinion gear 42. Thus, the cartridge holder 32 and that is, the cutter cartridge 40 are moved downward from the raised position. When the blade edge 4*a* of the cutter 4 and the underside 40*a* of the cutter cartridge 40 are pressed against the object S, further downward movement of the cutter cartridge 40 is disallowed. In this case, since the pinion gear 42 cannot be rotated further, it is stopped. However, when rotation of the Z-axis motor 38 is thereafter continued, only the driven gear member 41 is rotated with the result that the torsion coil spring 43 is flexed in a direction such that it is compressed. Thus, the pressure of the blade 4*c* of the cutter 4 for the cutting is set to a biasing force proportional to a deflection angle of the torsion coil spring 43. The pressure will hereinafter be referred to as "cutter pressure." Accordingly, when the cartridge holder 32 is located at the lowered position, a predetermined cutter pressure is obtained by setting a biasing force of the torsion coil spring 43 on the basis of an amount of rotation of the Z-axis motor 38. On the other hand, the cutter 4 is allowed to move upward against the biasing force of the torsion coil spring 43 even when the surface of the object S has an irregular part in the relative movement of the object S and the cutter 4 by the transfer mechanism 7 and the cutter moving mechanism 8.

When the Z-axis motor 38 is driven to be rotated counterclockwise in the front view, the driven gear member 41 is rotated clockwise in the front view. The driven gear member 41 directly presses the pinion gear member 42 to rotate it clockwise although a rotating manner is not shown in detail in the drawings. More specifically, the torsion coil spring 43 does not act when the driven gear member 41 is rotated clockwise. The rack 44 is moved upward by the gear 42*a* as the result of clockwise rotation of the pinion gear 42. Thus, the cartridge holder 32 and that is, the cutter cartridge 40 are moved upward from the lowered position.

Figure 5C:
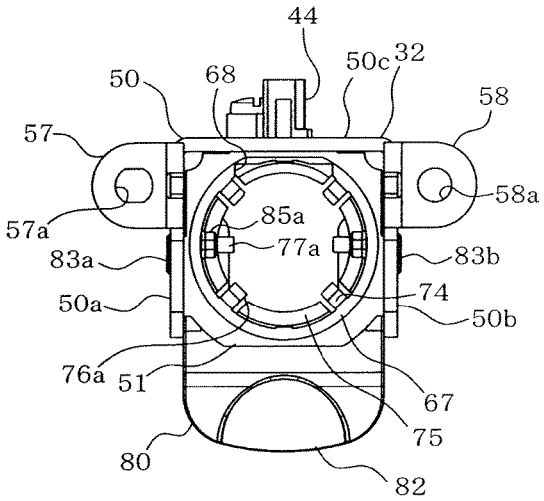
FIGS. 5A, 5B and 5C are a front view, a left side elevation and a plan view of the cartridge holder respectively.
Figure 5B:
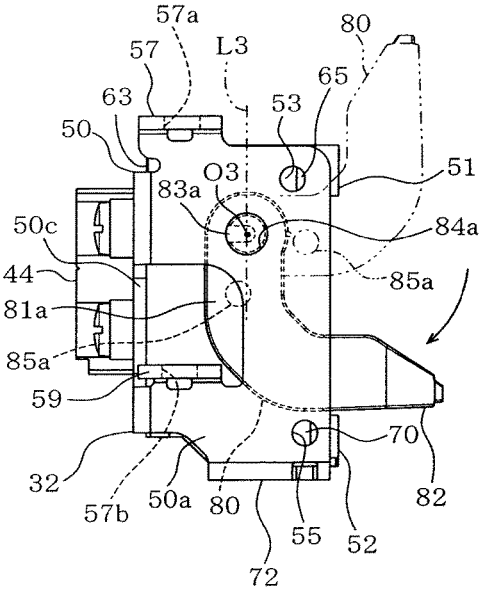
Figure 5A:
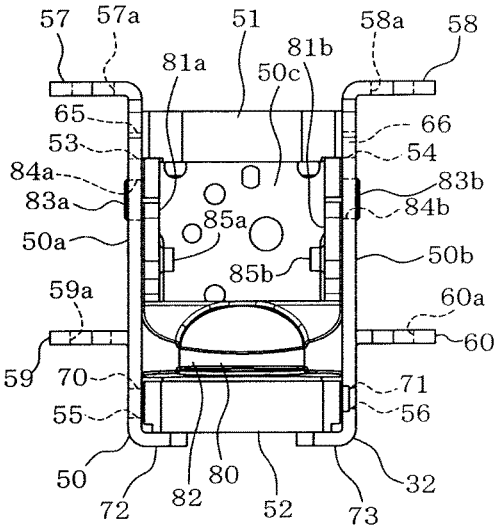

FIGS. 5A, 5B and 5C are a front view, a left side elevation and a plan view of the cartridge holder 32 respectively. The cartridge holder 32 includes a holder frame 50 provided with the rack 44 and an upper holder 51 and a lower holder 52 both fixed to the holder frame 50. The holder frame 50 is made of a metal material and has a top, an underside and a front all of which are open. The holder frame 50 has a rear wall 50*c* on which the rack 44 is mounted so as to extend in the up-down direction. The holder frame 50 includes right and left walls 50*b* and 50*a* further having upper ends formed with mounting holes 53 and 54 for the upper holder 51, respectively, as shown in FIG. 5A. The walls 50*a* and 50*b* have lower ends formed with mounting holes 55 and 56 for the lower holder 52 respectively. The right and left walls 50*b* and 50*a* are provided with paired support pieces 57 and 58 formed by outwardly folding the upper ends of the walls 50*b* and 50*a* respectively. The walls 50*a* and 50*b* are further provided with paired support pieces 59 and 60 formed by cutting and outwardly raising vertically midway portions of the walls 50*a* and 50*b* respectively. The support pieces 57 to 60 are formed with insertion holes 57*a*, 58*a*, 59*a* and 60*a* respectively.

The shaft 35 of the carriage 19 is inserted through the insertion holes 57*a* and 59*a* of the left support pieces 57 and 59 respectively. The other shaft 36 of the carriage 19 is inserted through the insertion holes 58*a* and 60*a* of the right support pieces 58 and 60 respectively. The holder frame 50 is thus supported so as to be movable along the shafts 35 and 36 of the carriage 19 in the up-down direction. A cover member 61 (see FIGS. 1 and 2) is attached to the carriage 19 to cover the support pieces 57 to 60 of the holder frame 50 and the shafts 35 and 36. The cover member 61 includes a central part formed with an opening (see FIGS. 1 and 2) through which the upper and lower holders 51 and 52 and an inner wall of the holder frame 50 are exposed.

The upper holder 51 is made of a resin material and formed into a frame shape such that the upper holder 51 is fitted into the holder frame 50. The upper holder 51 has an outer periphery formed substantially into a rectangular shape as shown in a plan view of FIG. 6A. The upper holder 51 further has a rear edge provided with a pair of right and left locking protrusions 64 and 63 formed integrally therewith. The upper holder 51 has right and left edges including slightly frontward parts having locking protrusions 66 and 65 formed integrally with the edges of the upper holder 51 respectively. The locking protrusions 63 and 64 are engaged with an upper edge of the rear wall 50*c* of the holder frame 50 to be locked. The locking protrusions 66 and 65 are inserted into the mounting holes 54 and 53 of the right and left walls 50*b* and 50*a* to be locked, respectively. As a result, the upper holder 51 is mounted on the holder frame 50.

Figure 6A:
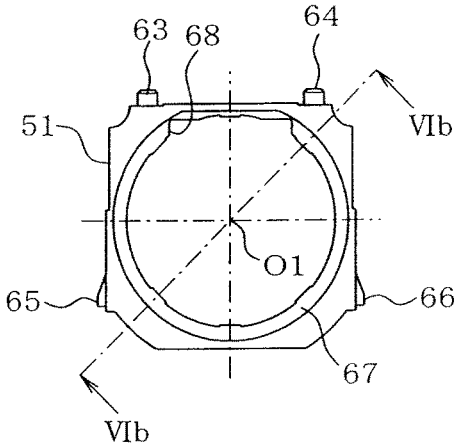
FIGS. 6A and 6B are a plan view of an upper holder and a longitudinal section taken along line VIb-VIb in FIG. 6A respectively.
Figure 6B:
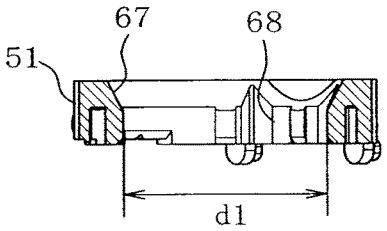
Figure 14:
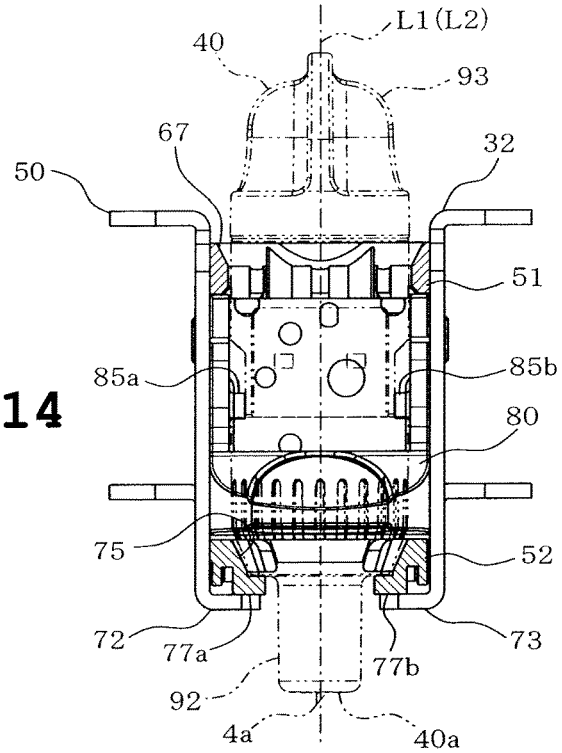
FIG. 14 is a front view of the cartridge holder with the cutter cartridge being attached thereto.

The upper holder 51 has an inner peripheral wall and an inner diameter d1 which is set so that the cutter cartridge 40 to be attached is fitted into the upper holder 51, as shown in FIGS. 6B and 14. The upper holder 51 includes a tapered portion 67 formed at the upper opening end side thereof. The tapered portion 67 is tilted on the top of the upper holder 51 so that the inner diameter D1 is increased and accordingly, the opening becomes larger, as the tapered portion 67 extends toward the upper end side. Furthermore, the upper holder 51 has an inner periphery formed with a concave cutout 68 as shown in FIG. 6B. The cutout 68 is formed into a shape corresponding with the rear of the cutter cartridge 40 while extending along a rear edge of the upper holder 51. As a result, the cutter cartridge 40 is attached in a predetermined direction to fit to the cutout 68 of the upper holder 51.

The lower holder 52 is also made of a resin material and formed into a frame shape in the same manner as the upper holder 51. The lower holder 52 has right and left edges having two locking protrusions 71 and 70 formed integrally with the lower holder 52 in the same manner as the upper holder 51, respectively. On the other hand, the walls 50*a* and 50*b* of the holder frame 50 having a pair of support pieces 72 and 73 formed by inwardly bending lower ends of the walls respectively, as shown in FIG. 5A. The locking protrusions 70 and 71 of the lower holder 52 are inserted into the mounting holes 55 and 56 of the holder frame 50 to be locked respectively. The lower holder 52 has a lower end which is supported by the support pieces 72 and 73 thereby to be mounted to the holder frame 50.

Figure 7A:
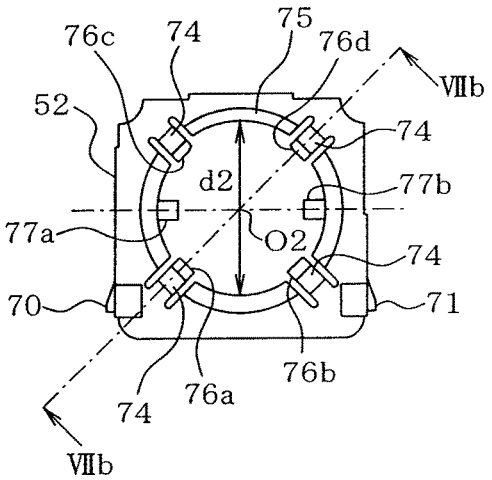
FIGS. 7A and 7B are a plan view of a lower holder and a longitudinal section taken along line VIIb-VIIb in FIG. 7A respectively.

The lower holder 52 has an inner periphery having an inner diameter set to the value of d2 allowing the lower end of the cutter cartridge 40 to be inserted through the lower holder 52 as shown in FIG. 7A. The lower holder 52 has first and second tapered portions 74 and 75 around an upper open end thereof. The tapered portions 74 and 75 and the tapered portion 67 of the upper holder 51 are formed to be concentric with one another relative to an axis line L1 as shown in FIG. 4B. The axis line L1 passes through centers O1 and O2 of the upper and lower holders 51 and 52 of the cartridge holder 32. More specifically, the second tapered portion 75 is tilted on the top of the lower holder 52 so that the inner diameter D1 is increased and accordingly, the opening becomes larger, as the second tapered portion 75 extends toward the upper end side. The second tapered portion 75 has a tilt angle α, which is set to be equal to that of a receiving portion of the cutter cartridge 40 as will be described later (see FIG. 3A). On the other hand, the top of the lower holder 52 is provided with elastic portions 76*a*, 76*b*, 76*c* and 76*d*, which are located at intervals of, for example, 90° around the upper open end of the lower holder 52. Each one of the elastic portions 76*a* to 76*d* is formed into a tongue piece shape or a reed shape as shown in FIG. 78B and is tilted inwardly downward from an outer edge of the second tapered portion 75 (the upper end).

Figure 7B:
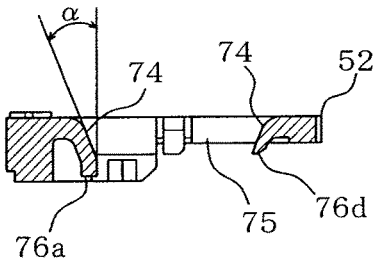

The elastic portions 76*a* to 76*d* have tilted surfaces formed on slightly raised positions relative to the second tapered portion 75 and serve as first tapered portions 74, respectively. The first tapered portions 74 have the same tilt angle as the second tapered portion 75. The first tapered portions 74 serve as abutting portions which abut against the receiving portion of the cutter cartridge 40 right above the second tapered portion 75. Each of the elastic portions 76*a* to 76*d* has opposite sides formed with respective cutouts extending radially outward from the inner periphery, as shown in FIG. 7A. Each of the elastic portions 76*a* to 76*d* functions as a spring piece by means of self-elasticity. As a result, the elastic portions 76*a* to 76*d* are elastically deformed when the receiving portion of the cutter cartridge 40 abuts against the first tapered portions 74. Each one of the rear elastic parts designated by reference symbols, 76*a* and 76*d*, has a smaller downward projecting dimension and a smaller thickness than the other elastic parts, as shown in FIG. 7B, whereby the rear elastic parts 76*a* and 76*d* are formed so as to avoid interference with other members. The rear elastic parts 76*c* and 76*d* may be formed into the same shape as the front elastic parts 76*a* and 76*b*. Furthermore, the number and the shapes of the elastic parts 76*a* to 76*d* may be changed in an appropriate manner. The receiving portion of the cutter cartridge 40 abuts against the elastic parts 76*a* to 76*d* as described above, whereupon the cutter cartridge 40 is positioned so that the axis line L2 (see FIG. 12) of the cutter 4 and the axis line L1 of the cartridge holder 32 correspond with each other.

Two blocking portions 77*a* and 77*b* are provided on the lower end side inner periphery of the lower holder 52, for example, at intervals of 180°. The blocking portions 77*a* and 77*b* protrude radially inward from the inner periphery of the lower holder 52, whereby the blocking portions 77*a* and 77*b* are formed so as to be paired on opposite sides of the inner periphery of the lower holder 52 to control the position of the cutter cartridge 40. Furthermore, as shown in FIG. 14, the blocking portions 77*a* and 77*b* are located on the support pieces 72 and 73 of the holder frame 50 respectively. As a result, the blocking portions 77*a* and 77*b* abut against the cutter cartridge 40 to prevent the cutter cartridge 40 from downward movement.

The holder frame 50 is provided with a lever member 80 serving as a pressing unit which presses the cutter cartridge 40, as shown in FIGS. 5A to 5C. The lever member 80 has a pair of respective right and left arms 81*b* and 81*a* and an operating portion 82 which connects between distal end sides of the cutter cartridge 40. The operating portion 82 extends in a direction perpendicular to the arm portions 81*a* and 81*b* or frontward as viewed in the side elevation of FIG. 5B. The lever member 80 thus includes the front half operating portion 82 constituting a distal end side and the second half arm portions 81*a* and 81*b* constituting a proximal end side and is formed into an L-shape as a whole. The arm portions 81*a* and 81*b* are generally formed into a plate shape and disposed so as to sandwich both sides of the cutter cartridge 40.

The lever member 80 has a proximal end side provided with two pivot shafts 83*a* and 83*b* (pivotal support portions) each formed into a small columnar shape. The pivot shafts 83*a* and 83*b* are located at outer surface sides of the arm portions 81*a* and 81*b* respectively. The pivot shafts 83*a* and 83*b* are inserted into circular holes 84*a* and 84*b* formed through the walls 50*a* and 50*b* of the holder frame 50 respectively. As a result, the lever member 80 is swung about the pivot shafts 83*a* and 83*b* serving as a center point O3, so as to be switchable between an open position shown by alternate long and two short dashes line in FIG. 5B and a fixing position shown by solid line in FIG. 5B.

Two small columnar engagement portions 85*a* and 85*b* are provided on the inner peripheries of the arm portions 18*a* and 81*b* so as to be located near the pivot shafts 83*a* and 83*b* respectively. The engagement portions 85*a* and 85*b* are located at the front side when the lever member 80 is switched to the open position. When located at the front side, the engagement portions 85*a* and 85*b* are noncontact with the cartridge 40. Furthermore, the cartridge 40 includes a cap 92 which will be described in detail later. The engagement portions 85*a* and 85*b* engage an upper end of the cap 92 from above when the lever member 80 is located at the fixing position. The engagement of the engagement portions 85*a* and 85*b* with the cap 92 causes the cartridge 40 to abut against the blocking portions 77*a* and 77*b*, so that the cartridge 40 is prevented from downward movement or movement in the pressing direction. In this case, furthermore, the cutter cartridge 40 is fixed while abutting against the tapered portions 74 of the elastic portions 76*a* to 76*d* to elastically deform the elastic portions 76*a* to 76*d* (see FIGS. 14 and 15). Furthermore, the engagement portions 85*a* and 85*b* are formed at locations displaced in a direction such that the lever member 80 is swung to the fixing position side relative to the vertical line L3 (in the direction of arrows in FIGS. 5B and 10). The vertical line L3 is an imaginary straight line passing the swinging movement center point O3 and is parallel to the axis line L2. Accordingly, in the construction that the cap 92 is pressed downward by the engagement portions 85*a* and 85*b*, a reactive force to the pressing force acts in the direction of swinging movement to the fixing position side.

On the other hand, the engagement portions 85*a* and 85*b* are disengaged from the cap 92 thereby to be released from the fixed state with the swinging movement of the lever member 80 from the fixing position in a direction opposed to the aforementioned arrow, that is, to the open position side. Thus, the cutter cartridge 40 is pressed by the engagement portions 85*a* and 35*b*, whereby the cutter cartridge 40 is releasably fixed by the lever member 80. The lever member 80 located at the fixing position retains the cutter 4 in a positioned state.

Figure 12:
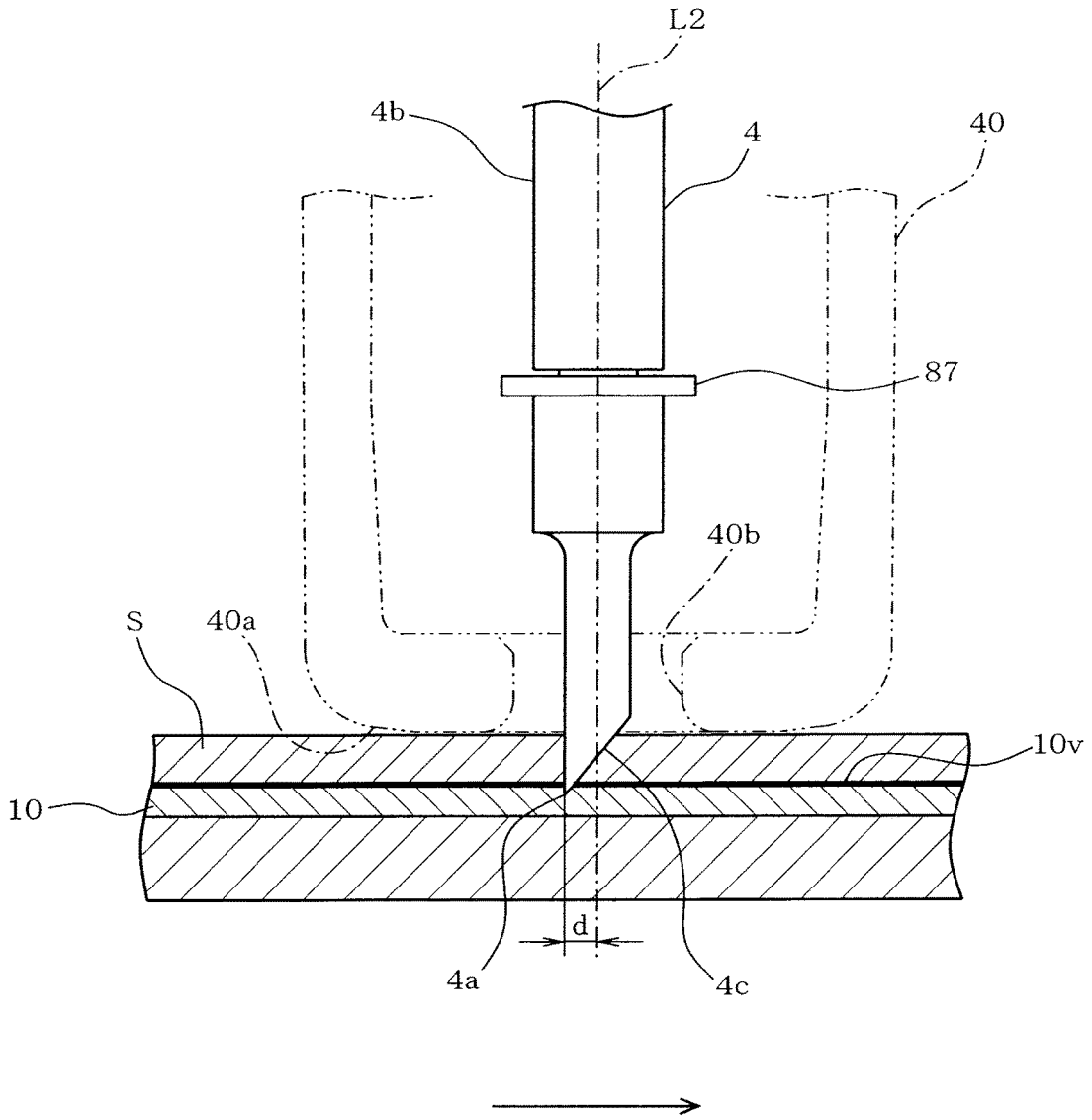
FIG. 12 is an enlarged view of a distal end of the cutter and the vicinity thereof during cutting.

The construction of the cutter cartridge 40 will now be described in detail with reference to FIGS. 8A to 9B and 12. The cutter cartridge 40 includes the cutter 4 and a casing 90. The cutter 4 includes a cutter shaft 4*b* and the blade 4*c* both of which are formed integrally therewith. The blade 4*c* constitutes a distal or lower end of the cutter 4. The cutter shaft 4*b* constitutes a base of the cutter 4 and is formed into the shape of a round bar. The cutter shaft 4*b* is housed in the casing 90. The cutter shaft 4*b* includes a lower part locked by a retaining ring 87. The blade 4*c* is formed into a generally triangular shape so as to be tilted relative to the object S. The blade 4*c* includes a lowermost blade edge 4*a* which is formed at a position displaced by distance d from an axis line L2 of the cutter shaft 4*b* as shown in FIG. 12.

Figures 8A, 8B, 8C:
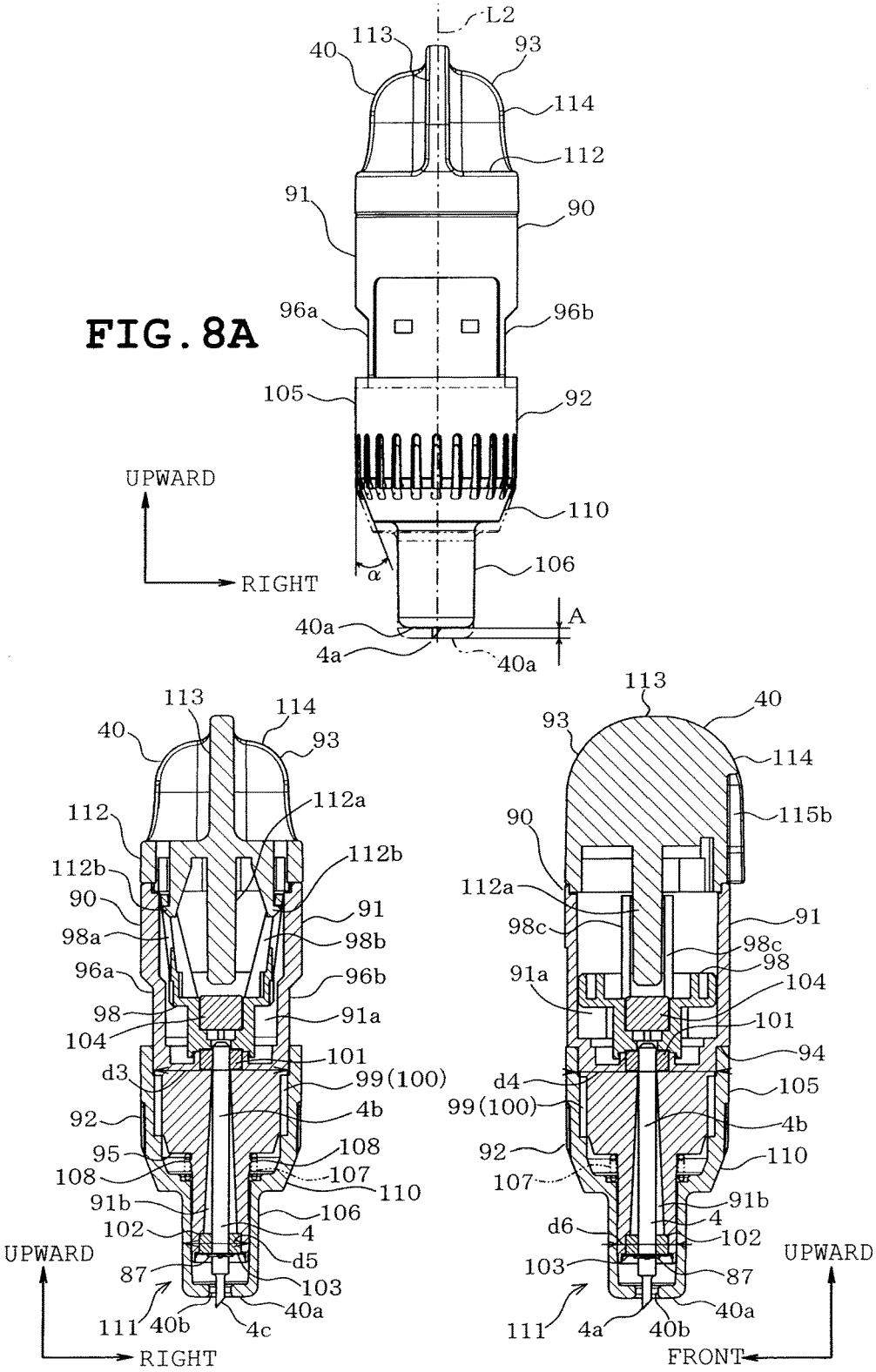
FIGS. 8A, 8B and 8C are a front view, a longitudinal front section and a longitudinal side section of the cutter cartridge respectively.
Figure 9A:
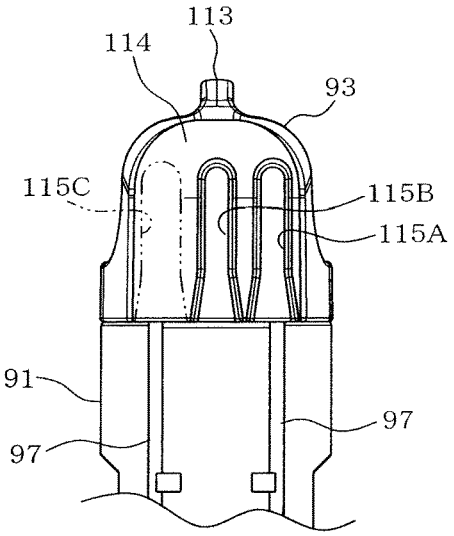
FIGS. 9A and 9B are a rear view and a plan view of an upper part of the cutter cartridge respectively.

The casing 90 includes a casing body 91, a cap 92 mounted on one of two ends of the casing body 91 and a knob 93 mounted on the other end of the casing body 91. The cap 92 and the knob 93 are made of a resin material. The casing body 91 is formed into the shape of a cylinder extending in the up-down direction. The casing body 91 is stepped so as to have a lower part including stepped portions 94 and 95 having respective smaller diameters (see FIGS. 8B and 8C). The casing body 91 includes right and left sides formed with respective escape portions 96*b* sand 96*a* located vertically midway in the casing body 91. The escape portions 96*a* and 96*b* are configured to avoid contact of the engagement portions 85*a* and 85*b* of the lever member 80 and the casing body 91. The casing body 91 further includes a rear formed with two guide protrusions 97 as shown in FIG. 9A. Each guide protrusion 97 extends linearly in the up-down direction. The guide protrusions 97 are guided in the up-down direction into the above-described cutout 68 of the upper holder 51. Accordingly, the cutter cartridge 40 is attached to the cartridge holder 32 so as to be directed according to the cutout 68 with the guide protrusions 97 being directed rearward.

An interior of the casing body 91 is defined into an upper half housing chamber 91*a* and a lower half housing chamber 91*b* both communicating with each other. A mounting member 98 is provided in the upper chamber 91*a* and the cutter shaft 4*b* is housed in the lower chamber 91*b*. The upper chamber 91*a* has an upper end and a lower end provided with bearing members 101 and 102 respectively. The cutter 4 is supported by the bearing members 101 and 102 so as to rotatable about the axis line L2. It is desirable that a bearing should be used as the bearing member 102. The upper housing chamber 91*a* includes a lower end surface provided with a retaining plate 103 for preventing the bearing member 102 from dropping.

The mounting member 98 is secured to the bottom of the upper chamber 91*a* of the casing body 91. The mounting member 98 has two mounting holes 98*a* and 98*b* and two mounting pieces 98*c* formed integrally with the mounting member 98, as shown in FIGS. 8*b* and 8C. The mounting holes 98*a* and 98*b* are each formed into a horny shape in order that the knob 93 may be mounted into the mounting holes 98*a* and 98*b*. A magnet 104 is provided in a central lower interior of the mounting member 98. The cutter shaft 4*b* is configured to be attracted upward by magnetic force of the magnet 104. Accordingly, the cutter shaft 4*b* is inserted through a through hole (not shown) of the retaining plate 103 from below. The cutter shaft 4*b* is then retained by the magnetic force of the magnet 104 at a position where the retaining ring 87 is locked to the retaining plate 103, so as to be prevented from movement in the direction of the axis line L2. The magnet 104 and the retaining plate 103 constitute a support 111 together with the above-described bearing members 101 and 102.

The casing body 91 includes an outer periphery having a male thread 99 located below the escape portions 96*a* and 96*b*. The male thread 99 is threadingly engageable with a female thread 100 of the cap 92. The male thread 99 has a pitch of thread set according to an adjusting allowance A of projection dimension of the blade edge 4*a* (the blade 4*c*) as shown in FIG. 8A. More specifically, the cap 92 shown by an alternate long and two short dashes line in FIG. 8A is located at a housed position where an underside 40*a* is flush with the blade edge 4*a*. On the other hand, the cap 92 shown by solid line in FIG. 8A is located at a maximum projected position where the upper end surface abuts against the stepped portion 94 (see FIG. 8C) of the casing body 91. A distance between the housed position and the maximum projected position serves as an adjusting allowance A. A screw pitch and the adjusting allowance A are set to substantially the same dimension in the embodiment. In this case, when the cap 92 located at the housed position is rotated a quarter turn, half turn and three-quarter turn, an amount of projection of the blade edge 4*a* can be adjusted sequentially to a quarter, half and three quarters of the maximum projection amount A. Furthermore, an axial dimension of the male thread 99 is set to a larger value than the adjusting allowance A. As a result, even in the case where the cap 92 is rotated by an extra amount to some degree when moved to the housed position, the cap 92 is prevented from dropping out of the casing body 91.

The cap 92 is formed into the shape of a stepped bottomed cylindrical container as a whole and includes a larger diameter portion 105 and a smaller diameter portion 106. The larger and smaller diameter portions 105 and 106 correspond to the stepped portions 94 and 95 of the casing body 91 respectively. The larger diameter portion 105 has an outer periphery formed with a plurality of equally-spaced narrow grooves. The narrow grooves extend downward substantially from a vertical middle of the outer periphery of the larger-diameter portion 105. The grooves serve as an antislip member when the user grips the cap 92 with his/her fingers to rotate it. The larger-diameter portion 105 has an inner periphery formed with a female thread 100, which is adapted to be threadingly engaged with the male thread 99 of the casing body 91. As the result of threading engagement of the threads 99 and 100, the cap 92 is coupled with the casing body 91 so that the position of the cap 92 is adjustable relative to the axis line L2.

A compression coil spring 107 is enclosed in the larger-diameter portion 105. The compression coil spring 107 is mounted to a lower part of the casing body 91. Accordingly, the cap 92 is normally biased downward by the compression coil spring 107 with the result that the threads 99 and 100 engaged with each other can be prevented from loosening and rattling. Consequently, an amount of projection of the blade edge 4*a* can reliably be adjusted. A small protrusion 108 is formed on the lower interior of the casing body 91 so as to be located at the stepped portion 95 side although not shown in detail. The compression coil spring 107 has an upper end locked to the protrusion 108. Accordingly, the compression coil spring 107 can be prevented from detachment from the casing body 91 when the cap 92 is detached from the casing body 91 during replacement of the cutter 4. Furthermore, the cutter 4 is held at the vertical position by the attractive force of the magnet 104 and the retaining ring 87 in the casing body 91. As a result, the cutter 4 can easily be detached from the casing body 91 when just downwardly dropped against the attractive force of the magnet 104 in replacement of the cutter 4.

The larger diameter portion 105 includes a frustoconical portion 110 on a lower part thereof. The frustoconical portion 110 serves as a receiving portion which abuts against the first tapered portion 74 of the cartridge holder 32. The frustoconical portion 110 has an outer surface which is tapered over an entire circumference of the larger diameter portion 105. Accordingly, the frustoconical portion 110 has a diameter that is gradually rendered smaller toward a lower part thereof. The frustocortical portion 110 is set to the tilt angle $\alpha$ equal to that of the first tapered portion 74. More specifically, the frustoconical portion 110 is concentric with the cutter shaft 4*b* or the frustoconical portion 110 has a center corresponding with the central axis L2 of the cutter shaft 4*b*. Thus, the frustoconical portion 110 is located near the blade 4*c* in the direction of the axis line L2 of the casing 90. The frustoconical portion 110 abuts against the first tapered portion 74 to be fitted with the latter. The tilt angle of the frustoconical portion 110 may be slightly larger than the tilt angle $\alpha$. In this case, the frustoconical portion 110 and the first tapered portion 74 can be removed more easily when the cutter cartridge 40 is detached from the cartridge holder 32.

The underside 40*a* of the smaller diameter portion 106 in the cap 92 is formed into a circular horizontally flat surface. The underside 40*a* is brought into a face-to-face contact with the object S. The underside 40*a* is formed with a hole 40*b* through which the blade 4*c* of the cutter 4 is passable. The cap 92 is assembled to the casing body 91 so as to cause almost no radial backlash. More specifically, the cap 92 includes a part which is located above the female thread 100 and has an inner diameter d3 as shown in FIGS. 8B and 8C. The casing body 91 includes a part which is located above the male thread 99 and has an outer diameter d4. A fit tolerance of the inner and outer diameters d3 and d4 is set to be as small as possible. In the same way, the smaller diameter portion 106 of the cap 92 has an inner diameter d5 and the lower end of the casing body 91 has an outer diameter d6. A fit tolerance of the inner and outer diameters d5 and d6 is set to be as small as possible.

The knob 93 has a lid plate 112, a knob plate 113 and a rear plate 114 formed integrally therewith. The lid plate 112 closes an upper surface of the casing body 91. The knob plate 113 and the rear plate 114 are mounted on an upper surface of the lid plate 112. The lid plate 112 has an underside formed with a bar-shaped portion 112*a* extending downward from the central underside and a pair of right and left claws 112*b*, as shown in FIGS. 8B and 8C. The claws 112*b* are locked to the casing body 91. As a result, the knob 93 is fixed to the casing body 91. The bar-shaped portion 112*a* prevents the magnet 104 from being pulled upward from the mounting member 98.

Figure 9B:
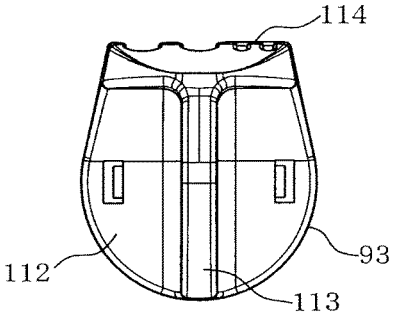

The knob plate 113 stands in the up-down direction on the horizontally central part of the lid plate 112. The knob plate 113 has a distal end or an upper edge side formed into an arc shape as shown in FIG. 8C. Furthermore, the rear plate 114 has an upper edge including right and left sides each formed into an arc shape as shown in FIG. 8A. Accordingly, the cutter cartridge 40 is adapted to lie down without standing when placed, for example, on a work table with cap 92 being directed upward. More specifically, the cutter cartridge 40 falls by its own weight even when placed on a plane with the knob 93 being directed downward. As a result, the blade edge 4*a* can be prevented from being directed upward when protruding out of the cap 92, whereby the cutter cartridge 40 can be handled safely. Furthermore, as shown in FIG. 9B, the rear plate 114 renders the rear outer periphery of the knob 93 planar in shape. Accordingly, the cutter cartridge 40 can be prevented from rolling even when caused to lie down, for example, on a work table, with the result that the cutter cartridge 40 can be prevented from falling from the work table and the blade edge 4*a* can be prevented from being broken.

The rear plate 114 of the knob 93 is formed with grooves 115A and grooves 115B extending in the up-down direction, whereby the rear plate 114 is concavo-convex, as exemplified in FIG. 9A. The grooves 115A and 115B have different concavo-convex patterns according to a type of cutter cartridge. Accordingly, the type of cutter cartridge 40 can be specified on the basis of the grooves 115A and 115B. More specifically, for example, another cutter cartridge different from the cutter cartridge 40 does not have a central groove 1151B in the rear plate and has a groove 115C on the right side of the eliminated central groove 115B (the left side as viewed in FIG. 9A). Thus, the cutter cartridge 40 and another cutter cartridge can be identified from each other on the basis of presence or absence of grooves 115A to 115C. Seven types of cutter cartridges can be identified on the basis of different patters of presence or absence of three grooves 115A, 115B and 115C in the rear plate 114.

Figure 11A:
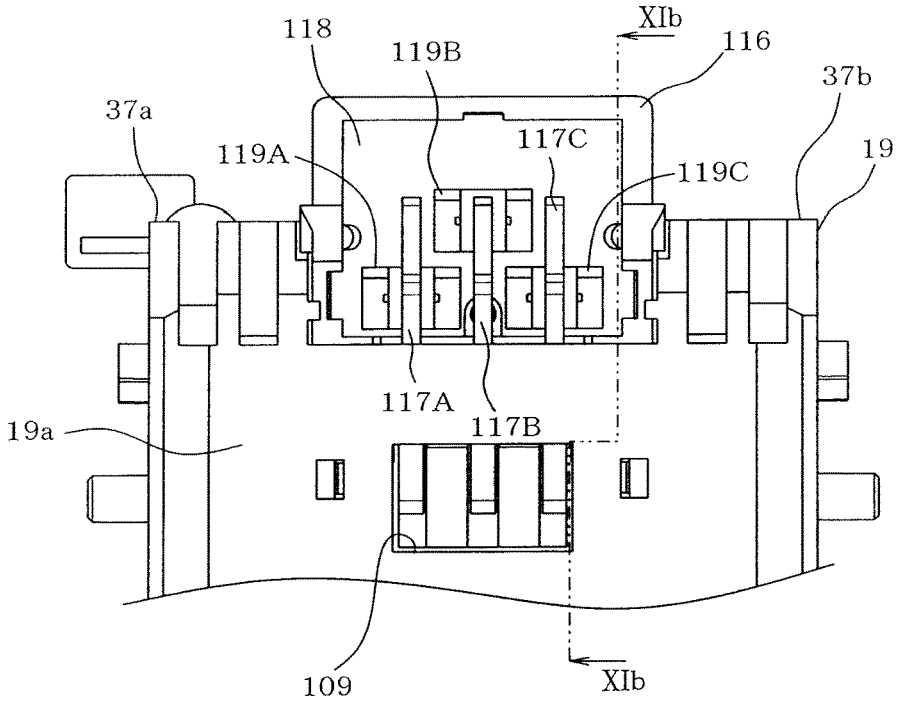
FIGS. 11A and 11B are a front view of the detection unit and the vicinity thereof and a longitudinal section taken along line XIb-XIb in FIG. 11A respectively.
Figure 11B:
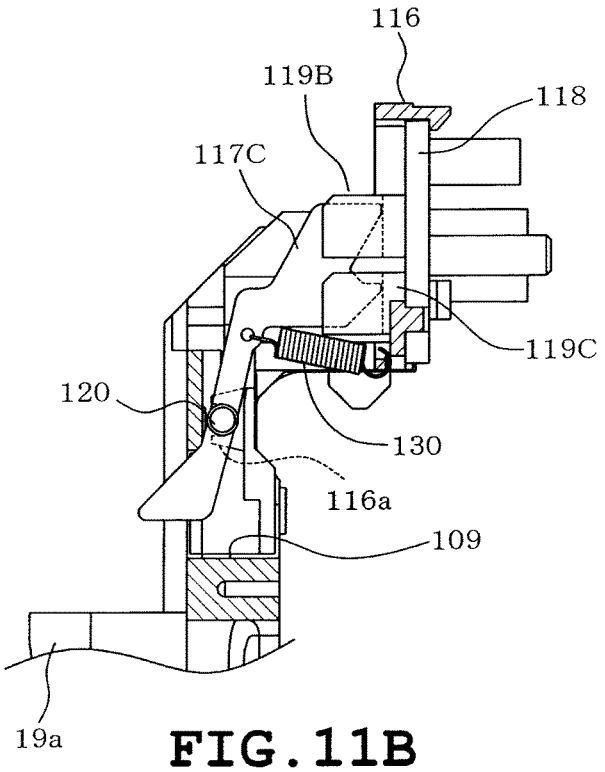

A detection unit is provided in the cartridge holder 32 of the carriage 19 in the embodiment. The detection unit is configured to identify the type of cutter cartridge. The detection unit includes three contacts 117A, 117B and 117C provided on a substrate holder 116 as shown in FIGS. 11A and 11B. Furthermore, three type detection sensors 119A, 119B and 119C are mounted on a substrate 118 of the substrate holder 116. More specifically, the substrate holder 116 is provided at the rear side of the holder frame 50 so as to be located between the upper arms 37*a* and 37*b*. The carriage 19 is formed with a generally rectangular hole 109 facing the rear plate 114 of the knob 93. The contacts 117A to 117C are each formed into a plate shape and extend from the rear plate 114 side to the side of the type detection sensors 119A-119C. Three shafts 120 are each formed on lengthwise midway portions of the contacts 117A to 117C respectively. The substrate holder 116 is provided with bearings 116*a* for the respective shafts 120. The contacts 117A to 117C arranged in the direction of plate thickness are swingably supported by the respective bearings 116*a*.

Three extension coil springs 130 extend between raised portions of the contacts 117A to 117C and the substrate holder 116 respectively. The contacts 117A to 117C are biased by the extension coil springs 130 in a direction such that upper ends of the contacts 117A-117C are inclined to the type detection sensor side. That is, the contacts 117A to 117C are biased in a direction such that the lower ends of the contacts 117A to 117C protrude from the hole 109 to come into contact with the rear plate 114 of the knob 93.

The type detection sensors 119A to 119C are provided on the substrate 118 as shown in FIG. 11A. The type detection sensors 119A to 119C are optical sensors serving as detectors and comprise respective photointerrupters. Only the centrally located type detection sensor 119B is disposed at a position displaced upward from those of the right and left type detection sensors 119C and 119A. The type detection sensors 119A to 119C are disposed in the above-described manner in order that the type detection sensors 119A to 119C may correspond to intervals of the contacts 117A to 117C in the right-left direction.

When the cutter cartridge 40 is attached to the cartridge holder 32, the lower end of the contact 1170 is brought into contact with the rear plate 114, whereby the contact 117C is swung. With this, the upper end of the cutter cartridge 40 is departed from the type detection sensor 119C (see alternate long and two short dashes line in FIG. 10). On the other hand, the other contacts 117A and 117B are retained in a tilted state so that the lower ends of the contacts 117A and 117B are located at the side of the grooves 115A and 115B and the upper ends of the contacts 117A and 117B are located at the side of the type detection sensors 119A and 119B. The upper end of each contact is bifurcated as shown in FIG. 11B. Thus, the shapes of the contacts 117A to 117C correspond to the arrangement of the type detection sensors 119A to 119C. As a result, the movement of the contacts 117A to 117C can reliably be detected even by the type detection sensors 119A to 119C disposed in the above-described manner.

The above-described cutter cartridge 40 is moved in the up-down direction by the up-down drive mechanism 33 while attached to the cartridge holder of the cutting head 5. When the cutter cartridge 40 is moved from a raised position to a lowered position by the up-down drive mechanism 33 (see FIG. 3), the blade edge 4*a* and the underside 40*a* of the cutter cartridge 40 press against the object S in turn. With this, the blade edge 4*a* and the underside 40*a* of the cutter cartridge 40 flex the torsion coil spring 43. The pressure of the cutter in this case is set according to the type of the cutter cartridge by a control circuit 121 (see FIG. 13) which will be described later. In this case, furthermore, an amount of projection of the blade edge 4*a* is adjusted by the user. Accordingly, the blade edge 4*a* passes through the object S on the holding sheet 10 thereby to cut slightly into the holding sheet 10, as shown in FIG. 12.

In this state, the holding sheet 10 is moved freely in the Y direction by the transfer mechanism 7 and the cutting head 5 is moved freely in the X direction by the cutter moving mechanism 8, whereby a cutting operation is executed for the object S. The cutting apparatus 1 is set with an X-Y coordinate system with a left corner of the holding sheet 10 serving as an origin O, as shown in FIG. 1, for example. The holding sheet 10 (the object S) and the cutting head 5 (the cutter 4) are moved relative to each other based on the X-Y coordinate system.

The cutting apparatus 1 is also provided with a scanner 6 reading an image of the object S (see FIGS. 2 and 13). The scanner 6 is composed of a contact type image sensor though it is not shown in detail. The contact type image sensor has a line sensor including a plurality of imaging devices juxtaposed in the X direction, for example. The scanner 6 is located on the back side of the guide rail 22 so as to be directed downward. The scanner 6 has substantially the same length as the width of the holding sheet 10 and extends in the X direction. The scanner 6 is used to read an image of the object S held by the holding sheet 10 (an original image of cutting data, for example) thereby to originate cutting data. The scanner 6 is also used to detect a position of the object S held by the holding sheet 10 and a size of the object S.

The configuration of control system of the cutting apparatus 1 will now be described with reference to FIG. 13. The control circuit (a control unit) 121 controlling the overall cutting apparatus 1 is mainly composed of a microcomputer (CPU). To the control circuit 121 are connected a ROM 122, a RAM 123 and an external memory 124. The ROM 122 stores a cutting control program, a cutting data originating program, a display control program, a cutting information table and the like. The cutting control program is provided for controlling a cutting operation. The cutting data originating program is provided for originating cutting data based on image data or the like. The display control program is provided for controlling a displaying operation of the display 9*a*. The cutting information data contains detection information from the three type detection sensors 119A to 119C and cutting information corresponding to each other. The cutting information includes data of cutter pressure set for every type of cutter cartridge and a relative movement speed (including speed data of the Y-axis motor 15 and the X-axis motor 25). The RAM 123 temporarily stores data and programs necessary for every processing.

To the control circuit 121 are supplied a read image signal from the scanner 6 and operation signals from various operation switches 9*b*. To the control circuit 121 are further supplied signals from the raised position detection sensor 45, the type detection sensors 119A to 119C and a sheet detection sensor 126. The sheet detection sensor 126 is provided for detecting a distal end of the holding sheet 10 set on the platen 3.

The external memory 124 stores cutting data on which a plurality of types of patterns is cut. The cutting data includes basic size information, cutting line data and display data. The basic size information includes values of horizontal and vertical sizes of patterns and is shape data corresponding to shapes of patterns. The cutting line data comprises coordinate value data indicative of XY coordinates of apexes of cutting line including a plurality of line segments. The coordinate value data is defined by the XY coordinate system of the cutting apparatus 1.

The display 9*a* is connected to the control circuit 121. A pattern selecting screen, an arrangement display screen and the like are displayed on the display 9*a*. The user operates various operation switches 9*b* while viewing the screen of the display 9*a*. As a result, the user can select a desired pattern and set a cutting position. Furthermore, to the control circuit 121 are further connected drive circuits 127, 128 and 129 driving the Y-axis motor 15, the X-axis motor 25 and the Z-axis motor 38 respectively. Upon execution of the cutting control program, the control, circuit 121 controls the Y-axis motor 15, the X-axis motor 25, the Z-axis motor 38 and the like so that a cutting operation is automatically executed for the object S on the holding sheet 10.

The control circuit 121 can execute an image reading operation by the scanner 6 before execution of the cutting operation. In this case, while the holding sheet 10 holding the object S is moved to the rear side of the platen 3 in the Y direction by the transfer mechanism 7, an image reading operation is carried out by the scanner in synchronization with the movement by the transfer mechanism 7. As a result, an image of the object S is obtained. The image is processed by a well known image processing technique, so that the position and the size of the object S on the holding sheet 10 are extracted. The extracted data is displayed on the display 9*a* and a cutting position is determined. Subsequently, the holding sheet 10 holding the object S and the cutting head 5 are moved relative to each other based on the cutting line data of the pattern, so that the aforementioned cutting operation is executed or the object S is cut along an outline of the pattern. A sheet-like object S such as paper on which an original drawing for cutting data origination and a photograph is held on the holding sheet 10. The cutting data can be originated by reading an image of the object S by the scanner 6.

The cutting apparatus 1 of the example is configured to cut the object using the cutter cartridge 40, as described above. Accordingly, even when an attached or mounted state of the cutter cartridge 40 to the cartridge holder 32 of the cutting head 5 changes slightly, there is a possibility of displacement from an original cutting line based on cutting data. In particular, the object S cannot sometimes be cut reliably when the cutter cartridge rattles up and down or an amount of projection of the blade edge 4*a* is not adjusted accurately, the cutting depth of the blade edge 4*a* to the object S becomes shallow. On the other hand, when the cutting depth of the object S is increased, the resistance the blade edge 4*a* receives from the object to be cut is increased with the result that sharpness of the blade edge 4*a* is reduced. Consequently, the possibility of damage to the blade edge 4*a* is increased. Furthermore, the cutting apparatus 1 of the example includes the scanner 6 which extracts the position and the size of the object S based on the read image and is configured to determine a cutting position based on the extracted data. Accordingly, the positional relation of the cutting line relative to the object S has a possibility of changing depending upon the mounting accuracy of the cutter cartridge 40.

In view of the above-described drawback, the frustoconical portion 110 of the cutter cartridge 40 abuts against the first tapered portion 74 of the cartridge holder 32, whereby the position of the central axis of the cutter 4 is accurately positioned at a predetermined position. Furthermore, the cutter cartridge 40 attached to the cartridge holder 32 is pressed by the lever member 80 thereby to be fixed. This can provide a high accurate cutting, preventing the cutter 4 from displacement.

Figure 15:
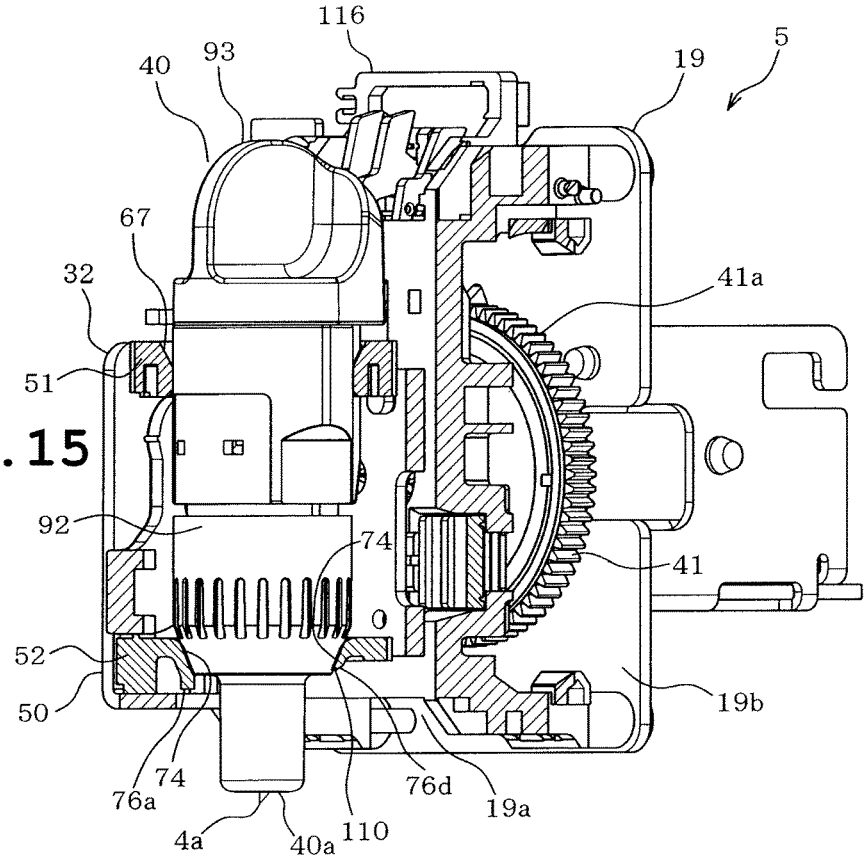
FIG. 15 is a longitudinal section taken along line XV-XV in FIG. 4A with the cutter cartridge being attached to the cartridge holder.

The operation of the cutting apparatus 1 will now be described with reference to FIGS. 14 and 15. In the following description, a sheet of paper as the object S to be cut is applied to the holding sheet 10, for example, as shown in FIG. 1. The cutter cartridge 40 corresponding to the paper will be attached. The cartridge holder 32 is located at the raised position before start of the cutting of the object S. The lever member 80 is assumed to be located at the open position.

The user previously adjusts an amount of projection of the blade edge 4*a* of the cutter 4 in the cutter cartridge 40. In this case, the user rotates the cap 92 to adjust the blade edge 4*a* so that an amount of projection of the blade edge 4*a* becomes slightly larger than a thickness of the object S. An amount of projection of the blade edge 4*a* can be adjusted accurately since the cap 92 is prevented from loosing and/or rattling of the screws 99 and 100 by the biasing force of the compression coil spring 107. The user then attaches the cutter cartridge 40 to the cartridge holder 32. In this case, the user pinches the knob plate 113 of the cutter cartridge 40 to attach the cutter cartridge 40 with the cap 92 side (the blade edge 4*a* side) of the casing 90 being directed downward. In the attachment, the cutter cartridge 40 is merely inserted through the upper and lower holders 51 and 52 in turn from above. In more detail, the cutter cartridge 40 is inserted through the upper holder 51 while the knob plate 113 is pinched at both sides thereof and the rear plate 114 is turned to the rear side. As a result, the cutter cartridge 40 is set to a predetermined direction in which the guide protrusions 97 are guided into the cutout 68 of the holder 51. The casing body 91 of the cutter cartridge 40 is supported by the inner periphery of the upper holder 51 (see FIG. 15). Furthermore, the frustoconical portion 110 of the cap 92 abuts against the first tapered portions 74 of the elastic portions 76*a* to 76*d* of the lower holder 52.

The user then pinches the operating portion 82 of the lever member 80 to swing the lever member 80 so that the lever member 80 is switched from the open position to the fixing position. In this case, the engagement portions 85*a* and 85*b* of the lever member 80 engage the upper edge or the peripheral edge of the cap 92 thereby to press the cap 92 downward. With this, the underside of the frustoconical portion 110 abuts against the blocking portions 77*a* and 77*b*, whereby the cutter cartridge 40 is prevented from downward movement (see FIG. 14). The cutter cartridge 40 is fixed while the elastic portions 76*a* to 76*d* are elastically deformed downward by the frustoconical portion 110 in abutment with the first tapered portion 74 (see FIG. 15). The cutter cartridge 40 thus fixed is located at a predetermined position where the central axis L2 of the cutter 4 corresponds with the central axis L1 of the cartridge holder 32.

Figure 10:
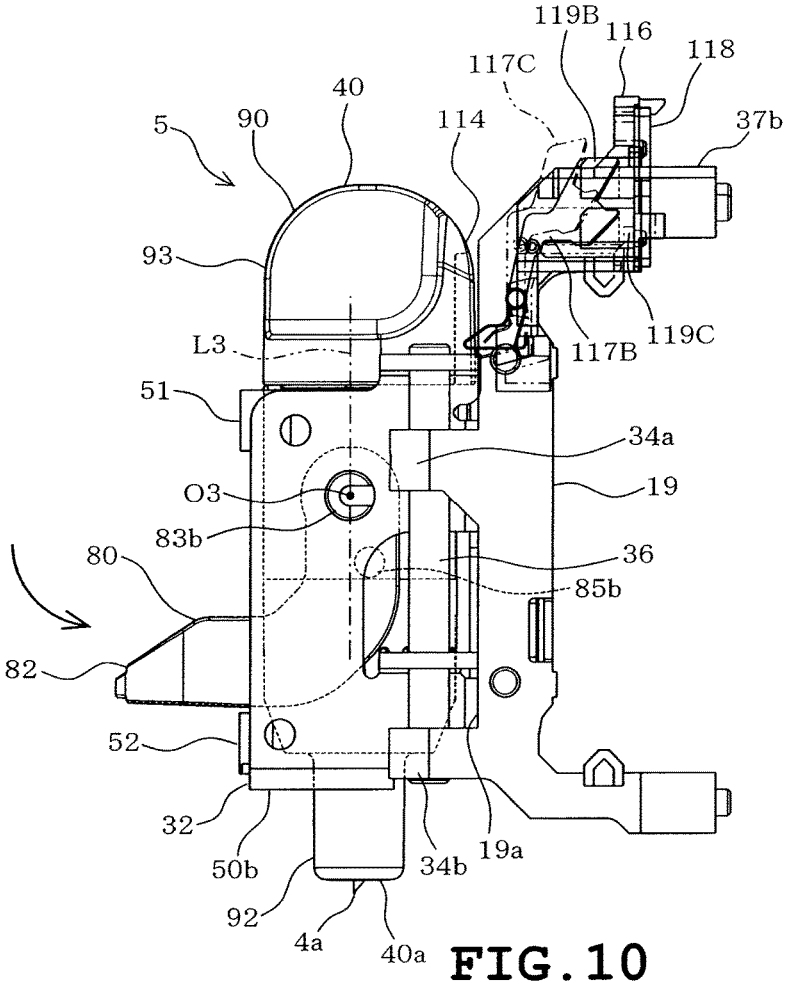
FIG. 10 is a right side view of the cartridge holder and a detection unit with the cutter cartridge being attached to the cartridge holder.

In this case, furthermore, the contact 117C contacts with the rear plate 114 of the cutter cartridge 40 set in the cartridge holder 32 thereby to be swung (see alternate long and two short dashes line in FIG. 10). On the other hand, the other contacts 117A and 117B are retained in a tilted state so as to be fitted into the grooves 115A and 115B of the rear plate 114 respectively. Thus, the type detection sensors 119A to 119C detect whether or not the contacts 117A to 117C have been moved respectively, whereby the control circuit 121 identifies the type of the cutter cartridge 40.

The user sets the holding sheet 10 holding the object S onto the platen 3 of the cutting apparatus 1 after having attached the cutter cartridge 40. In this case, the insertion of the holding sheet 10 is detected by the sheet detection sensor 126. The holding sheet 10 is then fed by the transfer mechanism 7 to the scanner 6 side, so that the aforesaid image reading process is carried out to extract the position and size of the object S on the holding sheet 10. The user further operates the operation switches of the operation device 9*b* to select cutting data of a desired pattern from the cutting data stored in the external memory 124. The user then operates the operation device 9*b* to instruct start of a cutting operation.

The control circuit 121 sets a cutting position of the pattern on the object S based on the extracted position and size of the object S. The control circuit 121 further checks the cutting information table based on detection signals from the contacts 117A to 117C to set data of a cutter pressure and speed data according to the type of the cutter cartridge 40. Accordingly, in the cutting operation of the cutting apparatus 1, the Y-axis and X-axis motors 15 and 25 are driven based on the cutting data and the speed data, whereby the pattern can be cut at a cutting speed suitable for the type of the object S. Furthermore, since a suitable cutter pressure determined on the basis of the cutter pressure data acts on the object S during the cutting, the object S can be prevented from being displaced from the holding sheet 10 in relation to the cutter pressure, and the motors 15 and 25 can be controlled so as not to lose steps. Furthermore, the cutter cartridge 40 is pressed by the lever member 80 in the cartridge holder 32 to be fixed and held by the elastic force of the elastic members 76*a* to 76*d* so as not to rattle. Consequently, a stable high accurate cutting can be carried out.

When, for example, a piece of cloth which is another type of object different from the object S is to be cut upon completion of the cutting of the object S, the cutter cartridge 40 is replaced by another cutter cartridge for cloth. In this case, the user switches the lever member 80 from the fixing position to the open position so that the cutter cartridge 40 is released from the fixed state. The knob plate 113 of the cutter cartridge 40 is pinched to be raised so that the cutter cartridge 40 is detached from the cartridge holder 32. The cloth cutter cartridge can be attached to the cartridge holder 32 reliably and easily and located at a predetermined position or positioned with the central axis L2 of the cutter 4 corresponding with the central axis L of the cartridge holder 32, in the same manner as described above regarding the cutter cartridge 40.

The cutting apparatus 1 of the example includes the pressing unit which is provided on the carriage 19 or the cartridge holder 32 so as to be switchable between the fixing position where the pressing unit presses the cutter cartridge 40 attached to the cartridge holder 32 thereby to fix the cutter cartridge 40 and the open position where the pressing unit releases the cutter cartridge 40 from the fixed state, as described above. The cutter cartridge 40 has the abutment and the cartridge holder 32 has the abutted portion against which the abutment abuts. At least one of the abutment and the abutted portion is formed into the tapered shape. The pressing unit is configured to press and fix the cutter cartridge 40 with the abutment abutting against the abutted portion when located at the fixing position, thereby holding the cutter 4 at a predetermined position.

According to the above-described construction, the cutter cartridge 40 is pressed and fixed by the pressing unit with the abutment thereof abutting against the abutted portion of the cartridge holder 32. Accordingly, even when the blade edge 4*a* of the cutter 4 is subjected to resistance to cutting from the object S during the cutting operation, the cutter cartridge 40 can be held in the cartridge holder 32 by the pressing force of the pressing unit so as to be prevented from rattling, with the result that displacement of blade edge 4*a* can be suppressed. Furthermore, since either the abutment of the cutter cartridge 40 or the abutted portion of the cartridge holder 32 is tapered, the cutter cartridge 40 attached to the cartridge holder 32 can be positioned accurately by the gradient. Consequently, the cutter 4 can be prevented from displacement resulting from replacement of the cutter cartridge 40 or the like. This can realize a reliable and high-accuracy cutting operation.

The cutter cartridge 40 includes the cutter 4 having the base extending in one direction and the blade 4*c* at the distal end side of the base and the casing 90 which houses at least the base of the cutter 4 and is provided with the abutment. The abutment formed into the tapered shape is concentric with the base or the abutment has a center corresponding with the central axis L2 of the cutter 4. According to this construction, the central axis L2 of the cutter 4 is located at the predetermined position where the cutter 4 is concentric with the tapered abutment. This can prevent the blade edge 4*a* from displacement.

The abutted portion of the cartridge holder 32 serves as a receiving portion having a tapered surface (the first tapered portion 74) which contacts with at least a part of the abutment. According to this construction, the cutter cartridge 40 is received by the abutted portion of the cartridge holder 32 thereby to be positioned or located at the predetermined position where the cutter 4 is concentric with the tapered surface or the central axis L2 of the cutter 4 corresponds with the center of the tapered surface. This can prevent the blade edge 4*a* from displacement.

The receiving portion includes a plurality of the elastic portions 76*a* to 76*d* which are formed with the respective tapered surfaces and elastically deformable and the blocking portions 77*a* and 77*b* which are provided on parts of the receiving portion except for the tapered surfaces and controls the position of the casing 90 in the pressing direction of the pressing unit. When the cutter cartridge 40 is attached to the cartridge holder 32 and the pressing unit is switched to the fixing position, the casing 90 abuts against the blocking portions 77*a* and 77*b* thereby to be prevented from movement in the pressing direction of the pressing unit, and the abutment abuts against the tapered surfaces of the elastic portions 76*a* to 76*d* with the result that the casing 90 is fixed with the elastic portions 76*a* to 76*d* being elastically deformed.

According to the above-described construction, when fixed by the pressing unit, the cutter cartridge 40 is held on the cartridge holder 32 by the elastic force of the elastic portions 76*a* to 76*d* so as not to rattle. This can realize the cutting operation with higher accuracy. Furthermore, since the position of the casing 90 in the pressing direction of the pressing unit is controlled by the blocking portions 77*a* and 77*b*, the casing 90 can reliably be positioned or located at the predetermined position.

The casing 90 includes the support 111 provided therein to support the base of the cutter 4 so that the base is rotatable about the central axis L2 and so that the base is immovable in the direction of the central axis L2. The casing 90 also includes the cap 92 covering the blade 4*c*. The abutment is formed over an entire circumference of the cap 92. According to the above-described construction, since the abutment is formed over the entire circumference of the cap 92, the cutter 4 can be positioned with higher accuracy irrespective of the circumferential position of the cutter cartridge 40 or the cap 92. Furthermore, accurate positioning of the cutter cartridge 40 can be realized by a simple construction that the abutment is formed on the cap 92 and the base of the cutter 4 is supported in the casing 90.

The cap 92 is configured so that the position thereof is adjustable in the direction of the central axis L2 relative to the support 111. According to this construction, the protrusion dimension of the blade 4*c* can be changed by position adjustment of the cap 92 in the direction of the central axis L2 of the cutter cartridge 40, with the result that the usability of the cutting apparatus 1 can be improved.

The pressing unit includes the lever member 80 which is operated so as to be switched between the fixing position and the open position and which is provided with the engagement portions 85*a* and 85*b* engaging the cap 92. When the lever member 80 is located at the fixing position, the engagement portions 85*a* and 85*b* engage the peripheral edge of the cap 92 thereby to press the cap 92 to the abutted portion side. According to the above-described construction, when the engagement portions 85*a* and 85*b* of the lever member 80 are caused to engage the peripheral edge of the cap 92 and are then pressed, the cutter cartridge 40 can be fixed by the cost-effective and simple construction. Furthermore, while pressed by the lever member 80 thereby to be fixed, the cap 92 is fixed without rotation. Accordingly, the protrusion dimension of the blade 4*c* protruding from the cap 92 remains unchanged even when the cutting operation is executed.

The lever member 80 further has the support portions (the pivot shafts 83*a* and 83*b*) located at the proximal end side and swingably supported on the carriage 19 and the operation portion 82 located at the distal end side and operated by the user. When the engagement portions 85*a* and 85*b* are located between the pivot shafts 83*a* and 83*b* and the lever member 80 is located at the fixing position, the engagement portions 85*a* and 85*b* are formed at the positions displaced in the direction in which the lever member 80 is swung to the fixing position side relative to an imaginary straight line L3 parallel to the central axis passing a swinging movement center O3 of the pivot shafts 83*a* and 33*b* when the lever member 80 is located at the fixing position.

According to the above-described construction, in the construction that the cap 92 is pressed to the abutted portion side by the engagement portions 85*a* and 85*b*, a reactive force of the pressure acts to swing the lever member 80 to the fixing position side. Accordingly, when located at the fixing position, the cutter cartridge 40 can reliably be fixed without inadvertent swing to the open position.

The carriage 19 is provided with the detection unit which is configured to detect the type of the cutter cartridge 40. According to the above-described construction, the type of the cutter cartridge 40 is detected and the cutting apparatus 1 can carry out the cutting in a manner according to the object S.

The casing 90 includes the knob 93 disposed on the end thereof located opposite the cap 92. The knob 92 is provided with the concavo-convex portion having a different shape according to the type of the cutter cartridge 40. The detection unit has the contacts 117A to 117C which are moved so as to be contactable with the concavo-convex portion and the detectors (type detection sensors 119A to 119C) detecting movement of the contacts respectively. According to the above-described construction, the type of the cutter cartridge 40 can be identified by detecting the movement of the contacts 117A to 117C contactable with the concavo-convex portion. Thus, the type detection can be carried out by a cost-effective and simple construction.

Figure 16:
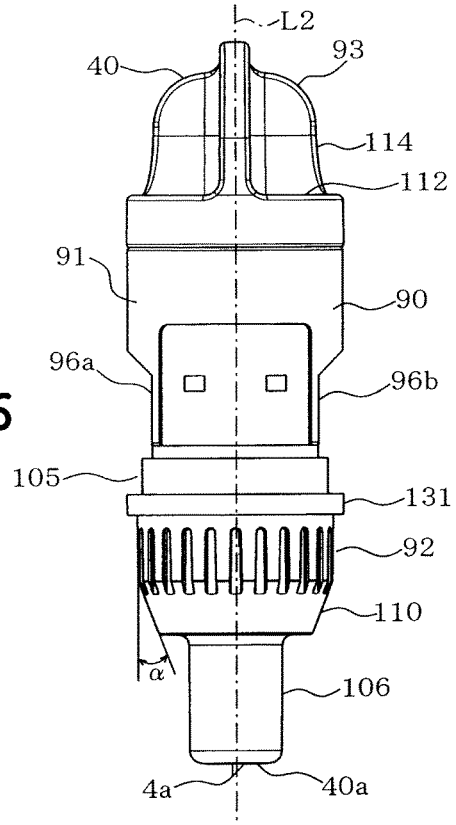
FIG. 16 is a view similar to FIG. 5A, showing a second example.
Figure 17:
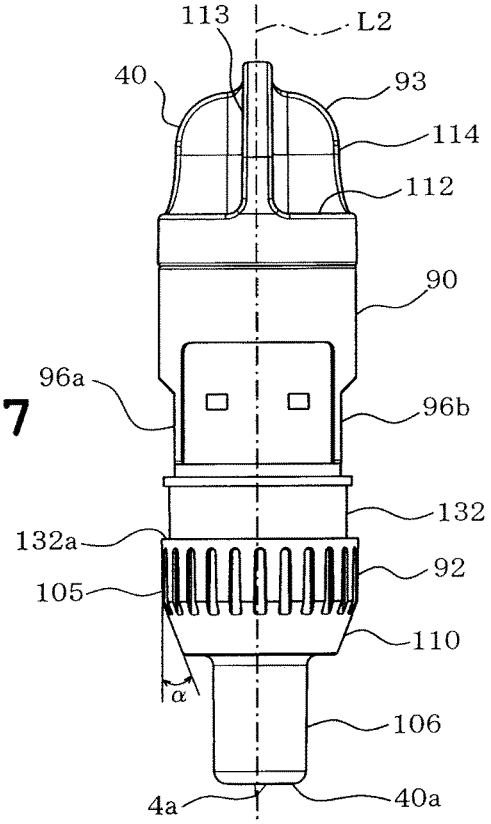
FIG. 17 is a view similar to FIG. 5A, showing a third example.

FIGS. 16 and 17 illustrate second and third examples respectively. Identical or similar parts in each of the second and third examples are labeled by the same reference symbols as those in the first example and the description of these parts will be eliminated. Only the differences between the second and third examples and the first example will be described in the following.

The cap 92 in the second example shown in FIG. 16 is provided with an annular convex portion 131 located substantially midway in the larger-diameter portion 105 in the up-down direction. The annular convex portion 131 protrudes radially outward over an entire circumference of the larger-diameter portion 105. The annular convex portion 131 serves as a circumferential edge of the cap 92. The lever member 80 located at the fixing position is configured so that the engagement portions 85*a* and 85*b* engage the annular convex portion 131 from above thereby to press the cap 92 downward when the cutter cartridge 40 is attached to the cartridge holder 32. By the engagement of the engagement portions 85*a* and 85*b* with the annular convex portion 131, the underside of the frustoconical portion 110 of the cutter cartridge 40 abuts against the blocking portions 77*a* and 77*b*. Furthermore, the cutter cartridge 40 is fixed while the elastic portions 76*a* to 76*d* are elastically deformed by the frustoconical portion 110.

The cap 92 in the third example shown in FIG. 17 is provided with an annular concave portion 132 which is located on the upper part of the larger-diameter portion 105. The annular concave portion 132 is recessed radially inward over an entire circumference of the larger-diameter portion 105 thereby to be formed into a groove shape. The annular concave portion 132 has a lower end formed with a circumferential edge 132*a* which is in parallel to an upper end of the cap 92. When the cutter cartridge 40 is attached to the cartridge holder 32, the engagement portions 85*a* and 85*b* of the lever member 80 located at the fixing position are located in the annular concave portion 132. Furthermore, the engagement portions 85*a* and 85*b* are configured to engage the circumferential edge 132*a* from above thereby to press the cap 92 downward. By engagement of the engagement portions 85*a* and 85*b* with the circumferential edge 132*a*, the underside of the frustoconical portion 110 of the cutter cartridge 40 abuts against the blocking portions 77*a* and 77*b*. The cutter cartridge 40 is fixed while the elastic portions 76*a* to 76*d* are elastically deformed by the frustoconical portion 110. Accordingly, each of the second and third examples achieves the same advantageous effect as achieved by the first example.

The invention should not be limited to the foregoing examples described with reference to the accompanying drawings but may be modified or expanded as follows. The invention should not be limited to the above-described cutting apparatus 1 as the cutting plotter but may be applied to various apparatuses provided with a cutting function.

Both of the abutment and the abutted portions may be formed into a tapered shape as exemplified above as the frustoconical portion 110 and the elastic portions 76*a* to 76*d* respectively. Alternatively, either the abutment or the abutted portions may be formed into a tapered shape. For example, the thicknesses of the elastic portions 76*a* to 76*d* may be set to be smaller so that the elastic portions 76*a* to 76*d* bend to a larger extent and the first tapered portion 74 may be eliminated. In this case, too, the cutter cartridge 40 is pressed by the lever member 80 thereby to be fixed. With fixation, the elastic portions 76*a* to 76*d* can be elastically deformed along the frustoconical portion 110. Consequently, the modified form achieves the same advantageous effect as the first example.

Furthermore, although the cartridge holder 32 is provided with the upper and lower holders 51 and 52 in the foregoing examples, the construction of the cartridge holder 32 should not be limited to this but may be modified. The cartridge holder 32 may be formed into a single holder having the first tapered portion 74.

The shapes of the cap 92, the knob 93 and the like of the cutter cartridge 40 should not be limited to those described above. For example, tapered portions may be formed on the cap 92 circumferentially at predetermined intervals, instead of the frustoconical portion 110. Furthermore, the distal end side of the knob 93 should not be limited to the above-described arc shape or curbed shape but may be formed into an inclined shape or may have an inclined surface. More specifically, when the cutter cartridge 40 is placed on a plane with the cap 92 being directed upward, the distal end of the knob 93 is formed into the inclined shape so that the knob 93 lies down by self-weight. Consequently, the safety can be improved as in the first example.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting apparatus comprising:

a platen receiving an object to be cut;

a carriage provided with a cartridge holder to which a cutter cartridge is detachably attachable;

a moving unit which moves the object so that the object is cut by a cutter of the cutter cartridge by the relative movement between the object and the carriage; and a pressing unit which is provided on the carriage or the cartridge holder and is switchable between a fixing position where the pressing unit presses the cutter cartridge attached to the cartridge holder thereby to fix the cutter cartridge and an open position where the pressing unit releases the cutter cartridge from a fixed state, wherein:

the pressing unit includes a lever member comprising a pair of arms having a proximal end and a distal end, the proximal end of each arm having a pivotal portion for pivoting relative to the cartridge holder between the fixing position and the open position, and the distal end of each arm having engagement portions provided on inner peripheries engaging the cutter cartridge at the fixing portion, and disengaging the cutter cartridge at the open position, the cutter cartridge has an abutment;

the cartridge holder comprises a holder frame having at least one holder having an open interior, inner periphery, and an inner diameter, the at least one holder having an abutted portion against which the abutment abuts in a state of which the cutter cartridge is disposed within the at least one holder;

at least one of the abutment and the abutted portion is tapered, and the abutted portion is a receiving portion having a tapered surface contacting with at least a part of the abutment;

the cutter cartridge includes a casing forming an outer part of the cutter cartridge and having an outer surface formed with the abutment;

the receiving portion includes a plurality of elastic portions which protrude radially inward from the inner periphery of the at least one holder and are elastically deformable tapered surfaces, and a blocking portion protrudes radially inward from a part of the inner periphery on a part of the receiving portion separate from the tapered surfaces, and the blocking portion positions the casing of the cutter cartridge in a direction in which the pressing unit presses the cutter cartridge; and the cutter cartridge is disposed within the open interior of the at least one holder and the pressing unit is switched to the fixing position, the casing abuts against the blocking portion preventing movement in the direction in which the pressing unit presses the cutter cartridge and is fixed in a state where the abutment abuts against the tapered surfaces of the elastic portions elastically deforming the elastic portions.

2. The apparatus according to claim 1, wherein the casing includes a support provided in the casing to support a base of the cutter so that the base of the cutter is rotatable about a central axis of the base and is immovable in a direction of the central axis, and a cap surrounding a blade of the cutter, and wherein the abutment is formed over an entire circumference of the cap.

3. The apparatus according to claim 2, wherein the cap is configured so that a position thereof is adjustable in a direction of the central axis of the base of the cutter relative to the support.

4. The apparatus according to claim 3, wherein the pressing unit includes a lever member operated to switch between the fixing position and the open position and the engagement portions engage the cap, and in a state of which the lever member is located at the fixing position, the engagement portion engages a peripheral edge of the cap thereby to press the cap to the abutted portion side.

5. The apparatus according to claim 4, wherein:

the engagement portions are located between proximal end and the distal end and are positioned displaced in a direction in which the lever member is swung to the fixing position relative to an imaginary straight line which is parallel to the central axis and passes a center of swinging movement of the proximal end in a state of which the lever member is located at the fixing position.

6. The apparatus according to claim 2, wherein the lever member is switched between the fixing position and the open position and the engagement portions engage the cap, and in a state of which the lever member is located at the fixing position, the engagement portion engages a peripheral edge of the cap thereby to press the cap to the abutted portion side.

7. The apparatus according to claim 6, wherein:

the engagement portions are located between the proximal end and the distal end and are positioned displaced in a direction in which the lever member is swung to the fixing position relative to an imaginary straight line which is parallel to the central axis and passes a center of swinging movement of the proximal end in a state of which the lever member is located at the fixing position.

8. The apparatus according to claim 1, wherein a plurality of types of cutter cartridges are prepared according to types of objects, and the carriage is provided with a detection unit which detects the type of the cutter cartridge.

9. The apparatus according to claim 8, wherein:

the casing includes a knob on an end located opposite a cap;

the knob is provided with a concavo-convex portion having a different shape according to the type of the cutter cartridge; and the detection unit has a contact which is movable so as to be contactable with the concavo convex portion and a detector detecting movement of the contact.

10. A cutting apparatus comprising:

a platen receiving an object to be cut;

a carriage provided with a cartridge holder to which a cutter cartridge is detachably attachable;

a moving unit which moves the object so that the object is cut by a cutter of the cutter cartridge by the relative movement between the object and the carriage; and a pressing unit which is provided on the carriage or the cartridge holder and is switchable between a fixing position where the pressing unit presses the cutter cartridge attached to the cartridge holder thereby to fix the cutter cartridge and an open position where the pressing unit releases the cutter cartridge from a fixed state, wherein:

the pressing unit includes a lever member comprising a pair of arms having a proximal end and a distal end, the proximal end of each arm being rotationally pivotably relative to the cartridge holder between the fixing position and the open position, and the distal end of each arm having engagement portions provided on inner peripheries of the pair of arms engaging the cutter cartridge at the fixing portion, and disengaging the cutter cartridge at the open position, the cutter cartridge has an abutment;

the cartridge holder comprises a holder frame having at least one holder having an open interior, inner periphery and an inner diameter, the at least one holder having an abutted portion against which the abutment abuts with the insertion of the cutter cartridge through the opening;

at least one of the abutment and the abutted portion is tapered, and the abutted portion is a receiving portion having a tapered surface contacting with at least a part of the abutment;

the cutter cartridge includes the cutter having a base extending in one direction and a blade provided at a distal end side of the base and a casing which houses at least the base of the cutter and is provided with the abutment;

the casing forms an outer part of the cutter cartridge and has an outer surface formed with the abutment which is tapered and is concentric with a central axis of the base;

the receiving portion includes a plurality of elastic portions which protrude radially inward from the inner periphery of the at least one holder and are elastically deformable tapered surfaces and a blocking portion protrudes radially inward from a part of the inner periphery on a part of the receiving portion separate from the tapered surfaces, and the blocking portion positions the casing unit presses the cutter cartridge; and the cutter cartridge is disposed within the open interior of the at least one holder and the pressing unit is switched to the fixing position, the casing abuts against the blocking portion preventing movement in the direction in which the pressing unit presses the cutter cartridge and is fixed in a state where the abutment abuts against the tapered surfaces of the elastic portions elastically deforming the elastic portions.

11. The apparatus according to claim 10, wherein the casing includes a support provided in the casing to support the base of the cutter so that the base of the cutter is rotatable about the central axis and is immovable in a direction of the central axis, and a cap surrounding the blade, and wherein the abutment is formed over an entire circumference of the cap.

* * * * *